US005639978A

United States Patent [19]

Saito

[11] Patent Number: 5,639,978

[45] Date of Patent: Jun. 17, 1997

[54] MUSICAL TONE SIGNAL GENERATING APPARATUS FOR ELECTRONIC MUSICAL INSTRUMENT

[75] Inventor: Tsutomu Saito, Shizuoka-ken, Japan

[73] Assignee: Kabushiki Kaisha Kawai Gakki Seisakusho, Shizuoka-ken, Japan

[21] Appl. No.: 543,081

[22] Filed: Oct. 13, 1995

[30] Foreign Application Priority Data

Oct. 14, 1994 [JP] Japan ..... 6-274277

[51] Int. Cl.[6] ..... G10H 7/00; G10H 7/02

[52] U.S. Cl. ..... 84/603

[58] Field of Search ..... 84/603–607, 615; 364/723, 724.1

[56] References Cited

U.S. PATENT DOCUMENTS

| | | | |
|---|---|---|---|
| 4,916,996 | 4/1990 | Suzuki et al. | 84/603 |
| 5,168,116 | 12/1992 | Iizuka | 84/603 |
| 5,288,940 | 2/1994 | Izumisawa | 84/603 |

FOREIGN PATENT DOCUMENTS 62-242995 10/1987 Japan .

*Primary Examiner*—Jonathan Wysocki
*Assistant Examiner*—Marlon T. Fletcher

[57] ABSTRACT

A musical tone signal generating apparatus for electronic musical instrument, comprising; (A) wave storage means for storing specific wave data $W_j$ where $0 \leqq j \leqq N-1$, and differential wave data $\Delta WD_n$ where n=1, 2, . . . N−1 and n≠j, the specific wave data $W_j$ being produced based on specific sampling data $D_j$, the differential wave data $\Delta WD_n$ being obtained by deducting sampling data $D_{n-1}$ from sampling data $D_n$, wherein sampling data $D_i$ consisting of the sample data $D_j$ and $D_n$ are obtained by sampling a musical tone wave at sampling points $P_i$ where i=0, 1, 2, . . . N−1; (B) readout means for consecutively reading out the specific wave data $W_j$ or the differential wave data $\Delta WD_n$ from the wave storage means; (C) temporary storage means; (D) decoding means for generating sampling data $YD_j$ and storing the sampling data $YD_j$ in the temporary storage means when the readout means reads out said specific wave data $W_j$, and for accumulating the differential wave data $\Delta WD_n$ in the temporary storage means when the readout means reads out the differential wave data $\Delta WD_n$, thereby to reproduce sampling data $YD_n$, and, (E) musical tone signal generating means for generating a musical tone signal on the basis of the obtained sampling data $YD_j$ or $YD_n$.

6 Claims, 14 Drawing Sheets

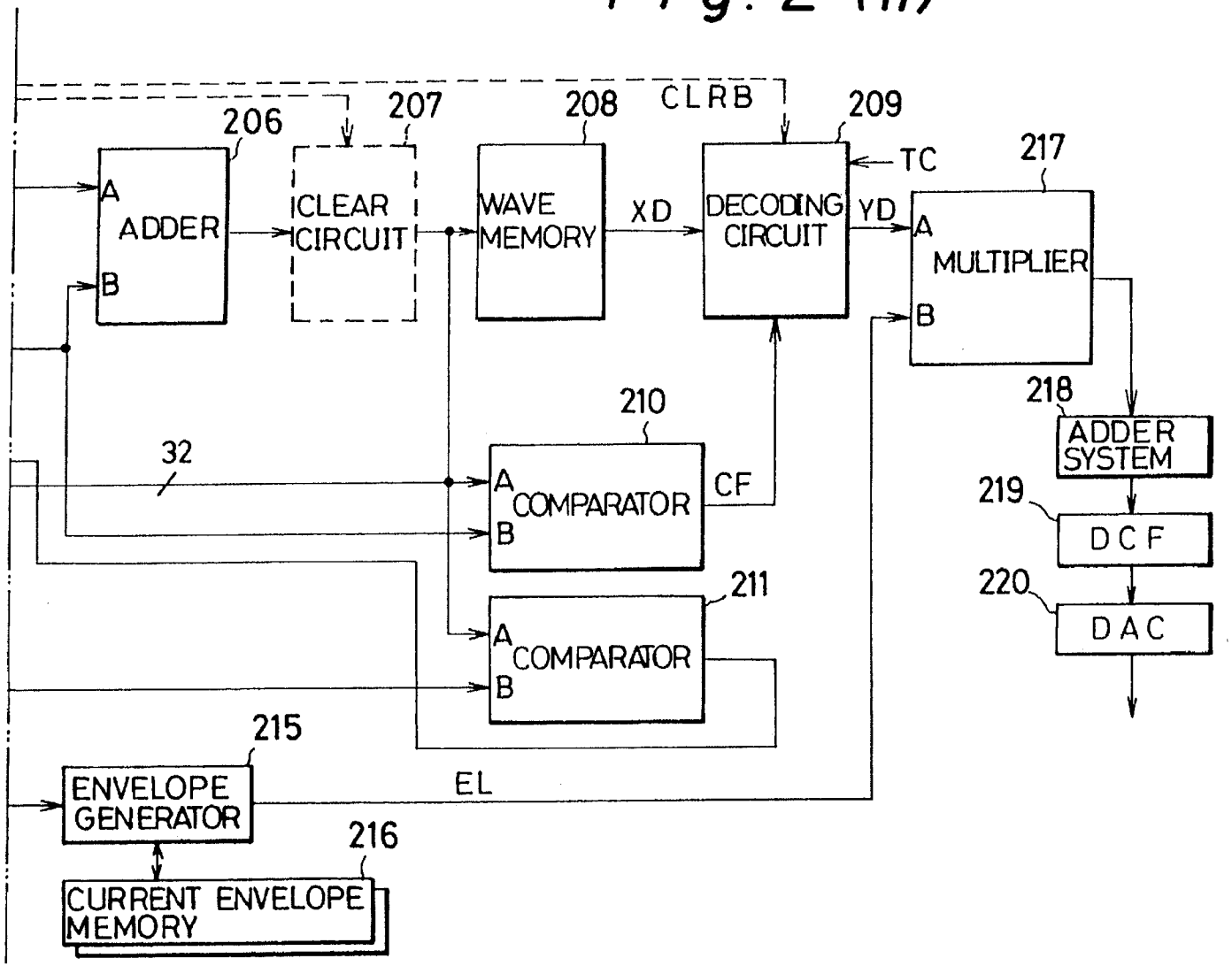
Fig. 2 (ii)

CONTROL FLAG
CLEAR CIRCUIT
CURRENT STEP MEMORY
CURRENT ADDRESS MEMORY
SELECTOR
LOOP TOP ADDRESS MEMORY
LOOP END ADDRESS MEMORY
BANK MEMORY
ENVELOPE PARAMETER MEMORY
CURRENT ENVELOPE MEMORY
ENVELOPE GENERATOR
COMPARATOR
DELAY LATCH
DELAY LATCH
LATCH
TIMING GENERATOR
CLRA
TC
SEL
CT
DB
CLK
AB
CNT
TC
CCK
EL16
16(A31-A16)
16(E31-E16)
16(B7-B0)
32(A31-A0)
16(T31-T16)
S1 S0
A
B
300
301
302
303
304
305
306
308
309
310
311
321
322
323
324
325
350

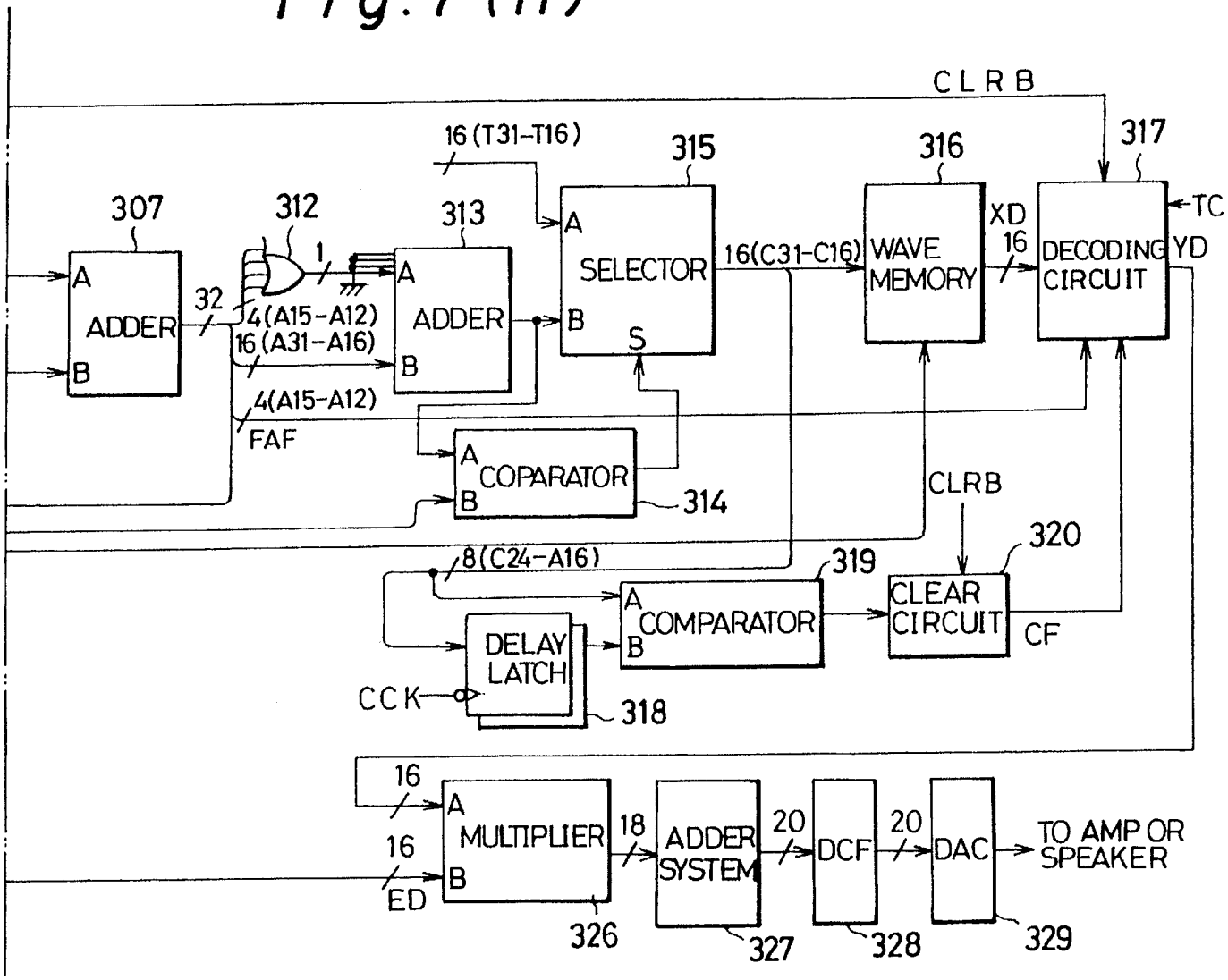
Fig. 7 (ii)

Fig. 8A

| 15 | 14 13 12 11 10 9 8 | 7 6 5 4 3 2 1 0 |
|---|---|---|
| ± | UPPER | LOWER |

Fig. 8B

| | | |
|---|---|---|
| 01111111********* | (X) | PCM PROCESS |
| 01111110111111111 | +7EFFH | DPCM PROCESS (DIFFERENTIAL VALUE) |
| 01111110111111110 | +7EFEH | |
| | | |
| 00000000000000001 | +0001H | |
| 00000000000000000 | 0H | |
| 11111111111111111 | −0001H | |
| | | |
| 10000001000000001 | −7EFFH | |
| 10000001000000000 | −7F00H | |
| 10000000111111111 | (Y) | PCM PROCESS |

Fig. 8C (X) 01111111********

↓

00000000******  +0000H~+00FFH (Y) 10000000******

↓

11111111********  −0100H~−0001H

MUSICAL TONE SIGNAL GENERATING APPARATUS FOR ELECTRONIC MUSICAL INSTRUMENT

BACKGROUND OF THE INVENTION AND RELATED ART

The present invention relates to a musical tone signal generating apparatus for generating a musical tone signal on the basis of wave data pre-stored in a wave memory.

Conventional electronic musical instruments include a musical tone signal generating apparatus. The musical tone signal generating apparatus generates a musical tone signal on the basis of wave data pre-stored in a wave memory. The wave memory stores, for example, wave data of PCM format. PCM data is produced by sampling a musical tone wave in a predetermined cycle, quantizing it and further coding it. The PCM data is consecutively read out from the wave memory according to a tone-generating instruction, and a musical tone signal is generated on the basis of the PCM data which has been read out.

In the above musical tone signal generating apparatus, it is required to pre-store a vast amount of PCM data in the wave memory for generating musical tone signals corresponding to a great number of timbres. For decreasing the amount of wave data in amount, there have been therefore proposed methods in which PCM data is compressed and then stored in the wave memory and the compressed wave data from the wave memory is expanded when a musical tone is generated. Among them are, for example, an ADPCM (Adaptive Differential Pulse Code Modulation) method and a DPCM (Differential Pulse Code Modulation) method. In these methods, differential wave data produced by calculating a difference between the sampling data at the adjacent sampling points of a musical tone wave are stored in the wave memory, and a musical tone signal is generated by accumulating the differential wave data from the wave memory when a musical tone is generated.

It is also general practice to employ the following method in order to decrease the amount of the wave data to be stored in the wave memory. That is, only wave data of a predetermined section (attack portion) which is a leading portion of a musical tone wave and wave data of a predetermined section (a repeat portion) which comes thereafter are stored in the wave memory, as shown in FIG. 12. When a musical tone signal is generated, the attack portion is read out only once from its beginning, and then the repeat portion is repeatedly read out. A musical tone generating apparatus generates a musical tone signal on the basis of the data which has been read out.

However, the above ADPCM and DPCM methods have been scarcely employed for a musical tone signal generating apparatus for electronic musical instruments. That is because the following first and second problems are involved. The first problem is that an accumulation error occurs when the method is employed in which wave data of the repeat portion is repeatedly accumulated. The second problem is that interpolation is required between adjacent two sampling points for generating a musical tone having a desired pitch since a sampled musical tone wave is discrete while a circuit for the interpolation is complicated.

Although having the above problems, the ADPCM method or the DPCM method has been and is vigorously studied for practical use since the data can be decreased in amount. For example, U.S. Pat. No. 4,916,996 (corresponding to JP-A-62-242995) discloses a musical tone generating apparatus with reduced data storage requirements for solving the first problem. This apparatus necessarily uses last data of an attack portion at the beginning portion of a repeat portion when decoding encoded wave data which has been repeatedly read out, thereby to remove an accumulation error.

Since, however, the above apparatus requires selectors 207, 217 for assessing the beginning portion of the repeat portion and latches 206, 218 for storing data (d(n), E(n)+$e_r$(n)) at an attack end time, it has a defect in that the circuit is complicated. Further, the method disclosed in U.S. Pat. No. 4,916,996 has a defect in that its control method is complicated when the wave data includes a plurality of repeat portions, which results in a complicated circuit.

Further, the above second problem has not yet been solved. For example, when a frequency number is fixed at "1", no interpolation is required since a wave readout address for reading out the wave data from a wave memory increments (+1) consecutively. Since, however, an actual electronic musical instrument requires a tuning function (function for shifting the pitch of an instrument as a whole in cents), a portamento function and a glide function, it is required to effect interpolation for finely controlling intervals. The interpolation requires a complicated circuit, since some pitches require a complicated control for producing a musical tone signal while making access to one sampling data a plurality of times.

OBJECT AND SUMMARY OF THE INVENTION

The present invention has been made for overcoming the above problems, and it is therefore an object of the present invention to provide a musical tone signal generating apparatus which can prevent the occurrence of an accumulation error caused by repetitive readout of wave data when a musical tone signal is reproduced by an ADPCM method or a DPCM method and which can also prevent an accumulation error at a non-repetitive readout time.

For achieving the above object, a musical tone signal generating apparatus according to the present invention comprises;

(A) wave storage means for storing specific wave data $W_j$ where $0 \leqq j \leqq N-1$, and differential wave data $\Delta WD_n$ where $n=1, 2, \ldots N-1$ and $n \neq j$, the specific wave data $W_j$ being produced based on specific sampling data $D_j$, the differential wave data $\Delta WD_n$ being obtained by deducting sampling data $D_{n-1}$ from sampling data $D_n$, wherein sampling data $D_i$ consisting of the sample data $D_j$ and $D_n$ are obtained by sampling a musical tone wave at sampling points $P_i$ where $i=0, 1, 2, \ldots N-1$, (B) readout means for consecutively reading out the specific wave data $W_j$ or the differential wave data $\Delta WD_n$ from the wave storage means, (C) temporary storage means, (D) decoding means for generating sampling data $YD_j$ and storing the sampling data $YD_j$ in the temporary storage means when the readout means reads out said specific wave data $W_j$, and for accumulating the differential wave data $\Delta WD_n$ in the temporary storage means when the readout means reads out the differential wave data $\Delta WD_n$, thereby to reproduce sampling data $YD_n$, and, (E) musical tone signal generating means for generating a musical tone signal on the basis of the obtained sampling data $YD_j$ or $YD_n$.

The specific wave data $W_j$ and the differential wave data $\Delta WD_n$ to be stored in the wave storage means are produced, for example, as follows. As shown in FIG. 12, an attack portion of a musical tone wave and a repeat portion which is a predetermined subsequent portion are extracted. Then, these attack and repeat portions are sampled at a predetermined cycle to obtain a plurality of sampling data $D_i$ (i=0, 1, 2, . . . N−1). The specific sampling data $D_j$ ($0 \leqq j \leqq N-1$) is selected from "N" pieces of the sampling data $D_i$. The content of the specific sampling data $D_j$ is a predetermined value. The number of the specific sampling data $D_j$ may be one or more. The specific wave data $W_j$ is produced (converted) based on the specific sampling data $D_j$. A format of the specific wave data $W_j$ may have the same format as that of the specific sampling data $D_j$, for example, PCM format. The content of the specific wave data $W_j$ may be equal to or be different from that of the specific sampling data $D_j$. The differential wave data $\Delta WD_n$ is obtained by deducting sampling data $D_{n-1}$ from sampling data $D_n$ (n=1, 2, . . . N−1 and $n \neq j$). The differential wave data $\Delta WD_n$ is of DPCM format or of ADPCM format.

In the musical tone signal generating apparatus according to the present invention, when each differential wave data $\Delta WD_n$ is read out from the wave storage means by the readout means, the differential wave data $\Delta WD_n$ is accumulated in the temporary storage means, that is, the differential wave data $\Delta WD_n$ read out and the sampling data $YD_n$ – stored in the temporary storage means are operated, for example, added, thereby to reproduce the sampling data $YD_n$. The obtained sampling data $YD_n$ is used for generating a musical tone signal. This accumulation is repeated, whereby the sampling data $YD_n$ (n=1, 2, . . . ) is consecutively renewed, and a musical tone signal which changes with the passage of time is generated.

On the other hand, when the specific wave data $W_j$ is read out from the wave storage means by the readout means, the decoding means generates the sampling data $YD_j$. The content of the sampling data $YD_j$ is the same as that of the specific sampling data $D_j$. Further, the obtained sampling data $YD_j$ is stored in the temporary storage means as an initial sampling data for accumulating the differential wave data $\Delta WD_n$ (n=j+1, j+2, . . . ).

According to the above constitution, an accumulation error inherent to the ADPCM or DPCM method can be removed. Further, in the present musical tone signal generating apparatus, an accumulation error can be removed not only in the case of reading out the specific wave data $W_j$ and the differential wave data $\Delta WD_n$ repeatedly but also in the non-repetitive readout in which the specific wave data $W_j$ and the differential wave data $\Delta WD_n$ is read out only once.

In a preferred embodiment of the musical tone signal generating apparatus of the present invention, the readout means includes F number generating means for generating F number to designate a pitch, and F number accumulating means for accumulating F number from the F number generating means at a predetermined cycle and for generating a wave readout address having an integer portion and a fraction portion, the decoding means includes interpolating means, the readout means reads out the specific wave data $W_j$ when the integer portion of the wave readout address has a value equal to j, and reads out the differential wave data $\Delta WD_n$ when the integer portion of the wave readout address has a value equal to n, from the wave storage means, the interpolating means interpolates between the sampling data $YD_{j+1}$ and $YD_j$ or between the sampling data $YD_{n+1}$ and $YD_n$ (n=1, 2, . . . N−2 and $n \neq j$) according to the value of the fraction portion of the wave readout address, thereby to obtain interpolation data YD, and, the musical tone generating means generates a musical tone signal on the basis of the interpolation data YD.

In this preferred embodiment, for example, when an instruction on key-ON is given, F number to designate a pitch is generated by the F number generating means.

According to this preferred embodiment, there is produced an effect that a musical tone signal generating apparatus which permits the fine pitch adjustment can be achieved.

In the musical tone signal generating apparatus of the present invention, the content of the specific sampling data $D_j$ may be zero. The content of the specific wave data $W_j$ may be equal to, for example, a minimum "8000H" ("H" in the last location shows a hexadecimal number, and is used in this sense hereinafter) or a maximum "7FFFH" or a value in the vicinity of any one of these. The content can be expressed by the form of complement of 2. Usually, the content of the differential wave data $\Delta WD_n$ is not such a value, so that the specific wave data $W_j$ can be distinguishable from the differential wave data $\Delta WD_n$.

When the specific wave data $W_j$ is read out from the wave storage means at the time of generating a musical tone signal, the reproduced sampling data $YD_{j-1}$ accumulated so far in the temporary storage means is discarded, and the content of the sampling data $YD_j$ has is set as fresh sampling data in the temporary storage means, whereby the accumulation is resumed from the sampling data $YD_j$.

When a musical tone wave is actually sampled, essential points such as a beginning position (start address SA), a loop start position (a loop top address LT) and a loop end position (a loop end address LE) of a musical tone wave are often selected for the specific sampling data $D_j$.

In the musical tone signal generating apparatus of the present invention, alternatively, the content of the specific sampling data $D_j$ may be within a predetermined extent. Such a predetermined extent may be, for example, 1/256 time the permitted maximum limit of the content of the sampling data $D_i$. In this case, since the content of the specific sampling data $D_j$ is within in a predetermined extent, unlike in case where the content of the specific sampling data $D_j$ is a value without any extent, the specific wave data $W_j$ can be easily produced.

In a preferred embodiment according to the musical tone signal generating apparatus of the present invention, the differential wave data $\Delta WD_{N-1}$ is obtained by deducting sampling data $D_{N-2}$ from sampling data $D_{M-1}$ where $1 \leqq M \leqq N-3$, the number of "j" satisfies the relation of $M<j<N-1$, and, the readout means reads out the differential wave data $\Delta WD_M$ again, after the readout means reads out the differential wave data $\Delta WD_{N-1}$. In this preferred embodiment, the value "M" is the content of the loop top address LT, and the value "N" is the content of the loop end address LE.

Alternatively, in a preferred embodiment according to the musical tone signal generating apparatus of the present invention, the specific wave data $W_j$ is stored in the wave storage means of location designated by j=M, and, the readout means reads out the specific wave data $W_j$ where j=M again, after the readout means reads out the differential wave data $\Delta WD_{N-1}$. In this preferred embodiment, the value "M" is the content of the loop top address LT, and the value "N" is the content of the loop end address LE.

As explained above, although having a simple circuit, the musical tone signal generating apparatus according to the present invention not only prevents the occurrence of an accumulation error caused by repetitive readout when a musical tone signal is generated by an ADPCM method or a DPCM method, but also prevents an accumulation error at a non-repetitive readout time.

BRIEF DESCRIPTION OF THE DRAWINGS

FIGS. 8A, 8B and 8C schematically show data used in Example 2 for a musical tone signal generating apparatus of the present invention.

DESCRIPTION OF THE PREFERRED EMBODIMENTS

Examples of the musical tone signal generating apparatus of the present invention will be explained hereinafter with reference to drawings. The present musical tone signal generating apparatus includes a tone source circuit, and a CPU for controlling the tone source circuit, etc. The constitution and operation of the CPU are well known, and therefore, the constitution and operation of the tone source circuit will be mainly explained hereinafter.

EXAMPLE 1

The musical tone signal generating apparatus of Example 1 generates a musical tone signal without carrying out interpolation of the sampling data. In Example 1, differential wave data $\Delta WD_n$ of ADPCM format and specific wave data $W_j$ of PCM format are used.

Figure 3A:
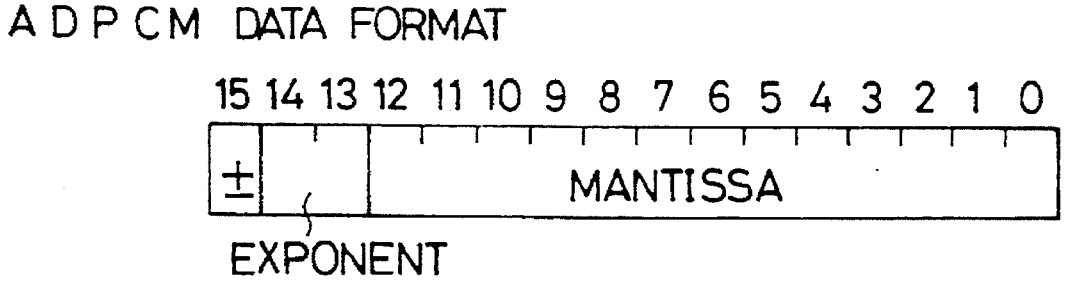
FIGS. 3A and 3B schematically show data used in Example 1 for a musical tone signal generating apparatus of the present invention.
Figure 4:
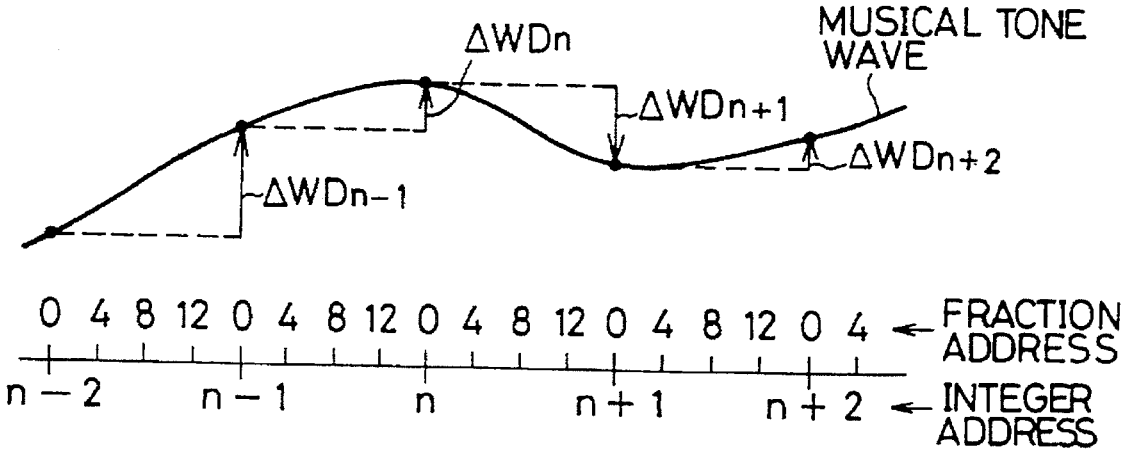
FIG. 4 schematically shows the method of producing wave data used in Example 1 of a musical tone signal generating apparatus of the present invention.

As shown in FIG. 3A, ADPCM data is data of floating point format, including of a sign (bit 15), exponents (bits 14, 13) and mantissa (bits 12–0). The ADPCM data is produced as follows. As shown in FIG. 4, a musical tone wave is sampled at a predetermined cycle at sampling points $P_i$ (i=0, 1, 2, . . . N−1), is quantized, and then is coded to produce sampling data $D_i$ (i=0, 1, 2, . . . N−1). The sampling data $D_i$ is of PCM format and is expressed by a 2's complement format. The differential wave data $\Delta WD_n$ is obtained by deducting sampling data $D_{n-1}$ from sampling data $D_n$ (n=1, 2, . . . N−1 and n≠j). The differential wave data $\Delta WD_n$ is of DPCM format, and is expressed by a 2's complement format. Therefore, the expression of a positive number or negative number is possible. In FIG. 4, for example, the differential wave data $\Delta WD_n$ ($=D_n-D_{n-1}$) standing for a difference between the sampling data $D_n$ and $D_{n-1}$ in sampling points $P_n$ and $P_{n-1}$ is obtained as positive number, and the data $\Delta WD_{n+1}$ ($=D_{n+1}-D_n$) standing for a difference between the sampling data $D_{n+1}$ and $D_n$ in sampling point $P_{n+1}$ and $P_n$ is obtained as negative number.

The so-obtained differential wave data $\Delta WD_n$ (n=1, 2, . . . N−1 and n≠j) may be converted to floating point format data having exponent corresponding to the magnitude of the absolute value. The differential wave data $\Delta WD_n$ produced by the above conversion is of ADPCM format. The so-produced differential wave data $\Delta WD_n$ of ADPCM format are stored in a wave memory 208 to be described later. The wave memory 208 corresponds to the wave storage means in the present invention.

In the process of producing the differential wave data $\Delta WD_n$ as described above, when the content of the sampling data $D_j$ of PCM format is a specific value of PCM format, for example, zero, special processing is carried out. That is, in this case, the specific wave data $W_j$ of PCM format is produced based on the specific sampling data $D_j$. The specific wave data $W_j$ is stored in the wave memory 208. Suppose that the content of the specific wave data $W_j$ is Z11.

A group including the specific wave data $W_j$ and a plurality of the differential wave data $\Delta WD_n$ (n=1, 2, . . . N−1 and n≠j) is referred to as a "wave data group" hereinafter. Further, the specific wave data $W_j$ or one of a plurality of the differential wave data $\Delta WD_n$ in the wave data group is referred to as "wave data of the wave data group" hereinafter.

As the content Z11, for example, minimum value "8000H" or maximum value "7FFFH" or a value in the vicinity thereof can be used. The content Z11 of the specific wave data $W_j$ is quite different from the contents of the differential wave data $\Delta WD_n$ in almost every case, so that the specific wave data $W_j$ is distinguishable from each of differential wave data $\Delta WD_n$. The minimum value "8000H" is used as one example of the content (value) Z11.

In Example 1, a wave readout address for reading out the differential wave data $\Delta WD_n$ or the specific wave data $W_j$ from the wave memory 208 is constituted of 32 bits data. The lower 16 bits of the wave readout address are used as a fraction address (an fraction portion). The upper 16 bits of the wave readout address are used as an integer address (an integer portion).

A loop top address LT includes 16 bits of data. The loop top address LT corresponds to the integer portion of the wave readout address. A loop end address LE includes 16 bits of data. The loop end address LE corresponds to the integer portion of the wave readout address. The loop top address LT is used to designate a beginning portion of a repeat portion of the wave data group. The loop end address LE is used to detect the ending portion of the wave data group.

Figure 5:
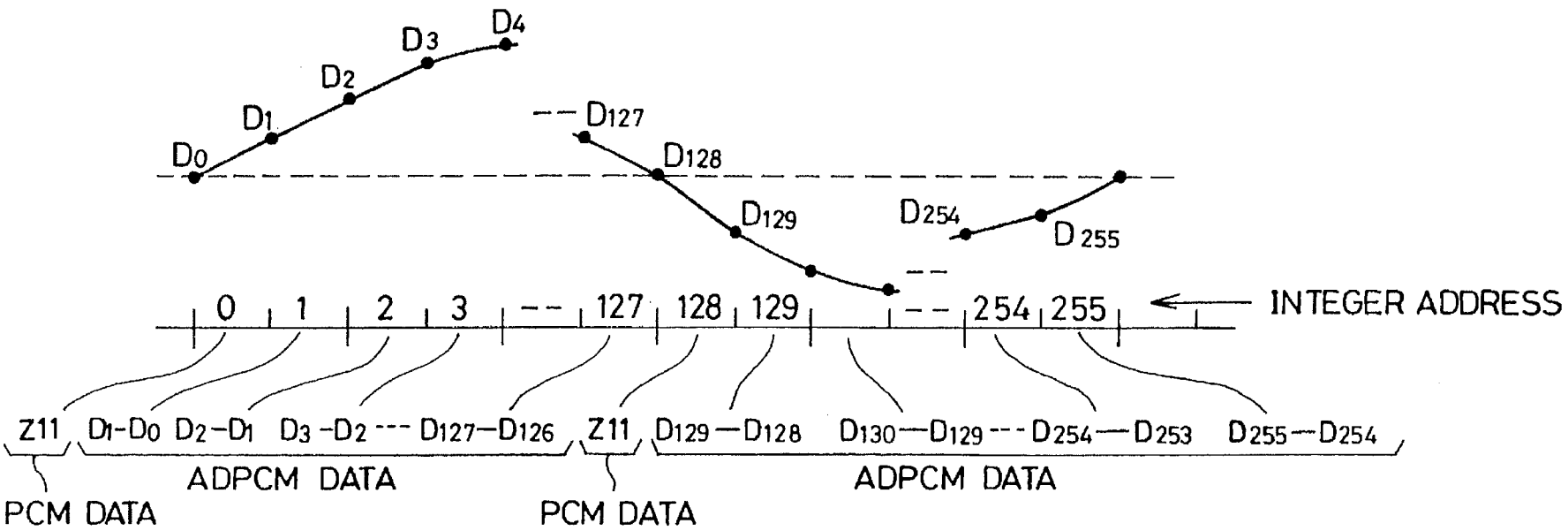
FIG. 5 schematically shows an example of storage of wave data in a wave memory in Example 1 for a musical tone signal generating apparatus of the present invention.

FIG. 5 schematically shows a state in which the above-produced specific wave data $W_j$ and the differential wave data $\Delta WD_n$ are stored in the wave memory 208. That is, at sampling points PD and $P_{128}$, the content of the sampling data $D_0$ and $D_{128}$, is zero, so that the specific wave data $W_j$ (j=0 and 128) of PCM format are produced and are stored in the locations of the wave memory 208 designated by addresses "0" and "128". The contents of the specific wave data $W_j$ (j=0 and 128), Z11 is "8000H" in Example 1. In other sampling points (i=1, 2, . . . 127, 129 . . . ), since the sampling data $D_i$ (i=1, 2, . . . 127, 129 . . . ) are not zero, the differential wave data $\Delta WD_n$ (i=1, 2, . . . 127, 129 . . . ) of ADPCM format are obtained by deducting sampling data $D_{n-1}$ from sampling data $D_n$ and stored in the locations of the wave memory 208 designated by addresses "1", "2", . . . "127", "129", . . . When the specific wave data $W_j$ is not stored in the wave memory 208 of the location designated by the address of "0", the content of the sampling data $D_0$ in the wave memory 208 of the location designated by the address of "0". In Example 1, the loop top address LT (M) is "128". That is, the content of the wave memory 208 designated by the loop top address LT (M="128") is the specific wave data $W_j$ (j=128).

(1) Explanations of Decoding Circuit

Figure 1:
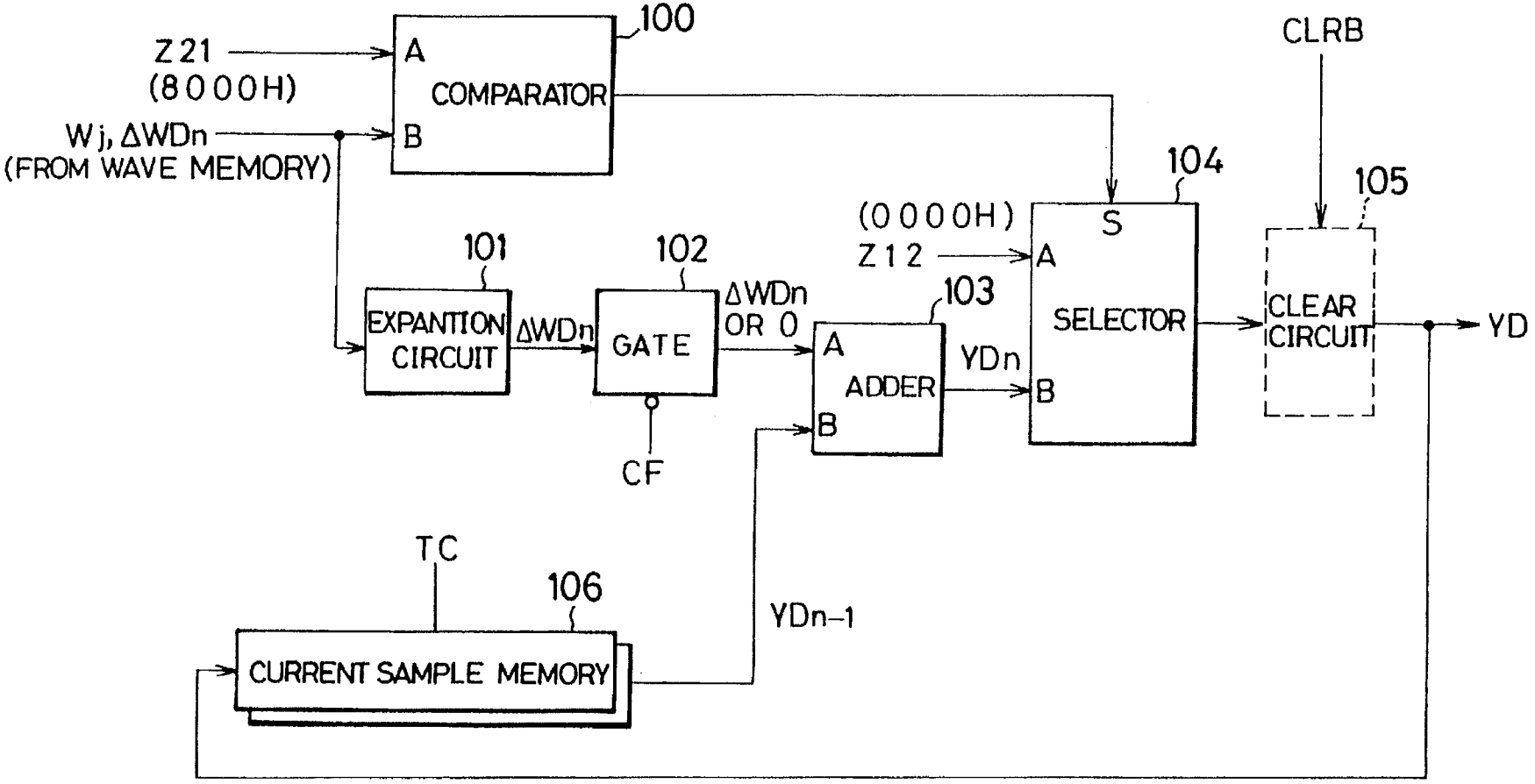
FIG. 1 is a block diagram of a decoding circuit adapted for a tone source circuit in Example 1 for a musical tone signal generating apparatus of the present invention.

FIG. 1 is a block diagram showing a decoding circuit 209 (see FIG. 2) adapted for the tone source circuit. The decoding circuit 209 corresponds to the decoding means and the temporary storage means.

In FIG. 1, a comparator 100 compares the specific wave data $W_j$ or the differential wave data $\Delta WD_n$ (the wave data of the wave data group) from the wave memory 208 with the value Z21. The value Z21 is equal to content of the specific wave data $W_j$. That is, the value Z21 may be stored, for example, in a ROM or a register (not shown). As the value Z21, for example, minimum value "8000H" or maximum value "7FFFH" or a value in the vicinity thereof can be used. The minimum value "8000H" is used as one example of the value Z21. When the result of the comparison is that the above two are identical, "1" is generated as a control signal, and if this is not the case, "0" is generated, in the comparator 100. This control signal is supplied to an input terminal S of a selector 104.

Figure 3B:
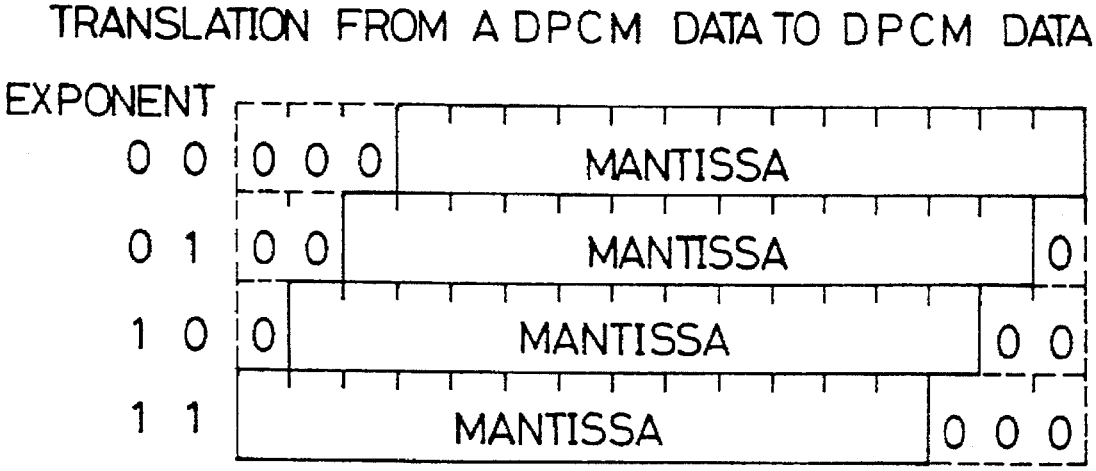

An expansion circuit 101 receives the differential wave data $\Delta WD_n$ from the wave memory 208, and converts the differential wave data $\Delta WD_n$ from ADPCM format to DPCM format. In this conversion, a compressed quantization width is restored to its original state. Conceptually, as shown in FIG. 3B, the value of the mantissa is shifted leftward depending upon the value of exponent of ADPCM data, so that the ADPCM data is converted to DPCM data having a fixed point format and a 2's complement format. When the differential wave data $\Delta WD_n$ stored in the wave memory 208 is of DPCM format, the expansion circuit 101 can be omitted. When the expansion circuit 101 receives the specific wave data $W_j$ from the wave memory 208, the expansion circuit 101 outputs the converted specific wave data. The differential wave data $\Delta WD_n$ or the converted specific wave data is supplied to a gate 102.

A current sample memory 106 corresponds to the temporary storage means. The differential wave data is accumulated in the current sample memory 106. Suppose that the differential wave data $\Delta WD_{n-1}$ has been accumulated in the current sample memory 106 and the sampling data $YD_{n-1}$ has been reproduced and stored in the current memory 106. The musical tone signal generating apparatus of the present invention is capable of simultaneously generating a plurality of musical tone signals. The current sample memory 106 includes of a plurality of blocks corresponding to a plurality of tone generating channels. Each of the blocks of the current sample memory 106 corresponds to each wave data group. The number of the blocks equal to the number of time division. It is determined by a timing signal TC from a timing generator 201 (to be described later) which block is activated. This constitution will be referred to as "time-sharing constitution" hereinafter. The sampling data $YD_{n-1}$ from the current sample memory 106 is supplied to an input terminal B of an adder 103.

When an identity signal CF is "0", the gate 102 allows the differential wave data $\Delta WD_n$ or the converted specific wave data from the expansion circuit 101 to directly pass. If the identity signal CF is "1", zero is outputted from the gate 102. The identity signal CF is produced in a comparator 210 to be described later (see FIG. 2). It is decided depending upon the identity signal CF whether or not the differential wave data $\Delta WD_n$ is accumulated on the sampling data $YD_{n-1}$. The output of the gate 102 is supplied to an input terminal A of an adder 103.

The adder 103 adds the output of the gate 102 to the sampling data $YD_{n-1}$ from the current sample memory 106, whereby the sampling data $YD_n$ is obtained. The sampling data $YD_n$ from the adder 103 is supplied to an input terminal B of the selector 104.

The selector 104 selects either data having the value Z12 supplied to an input terminal A or the sampling data $YD_n$ supplied to the input terminal B from the adder 103, depending upon the control signal from the comparator 100. As the above value Z12 is equal to the content of the specific sampling data $D_j$, zero (0000H). The value Z12 may be stored, for example, in a ROM or a register (not shown). When the selector 104 receives the control signal "1" from the comparator 100, the input terminal A of the selector 104 is selected, whereby the selector 104 outputs the sampling data $YD_j$, the content of which is the same as that of the specific sampling data $D_g$, to a clear circuit 105. On the other hand, when the selector 104 receives the control signal "0" from the comparator 100, the input terminal B of the selector 104 is selected, whereby the selector 104 outputs the sampling data $YD_n$ to the clear circuit 105.

The clear circuit 105 either directly passes the inputted data or forcefully outputs zero depending upon a clear signal CLRB. The clear circuit 105 is used for clearing the content of the current sample memory 106, when the readout of the wave data of the wave data group is initiated. Therefore, if the wave data group has data having the value of zero in the beginning thereof, the clear circuit 105 can be omitted.

The clear circuit 105 is controlled by the control signal CLRB from a control flag latch 202 (see FIG. 2) whether or not the clear circuit 105 is activated to output zero. The content of the control flag latch 202 is set or reset by data from the CPU (not shown). The output of the clear circuit 105 is supplied to the current sample memory 106. As a result, the sampling data $YD_j$, $YD_n$ or zero is stored in the current sample memory 106. The output of the clear circuit 105 is also supplied to a multiplier 217 to be described later.

(2) Explanation of Tone Source Circuit

Figure 2:
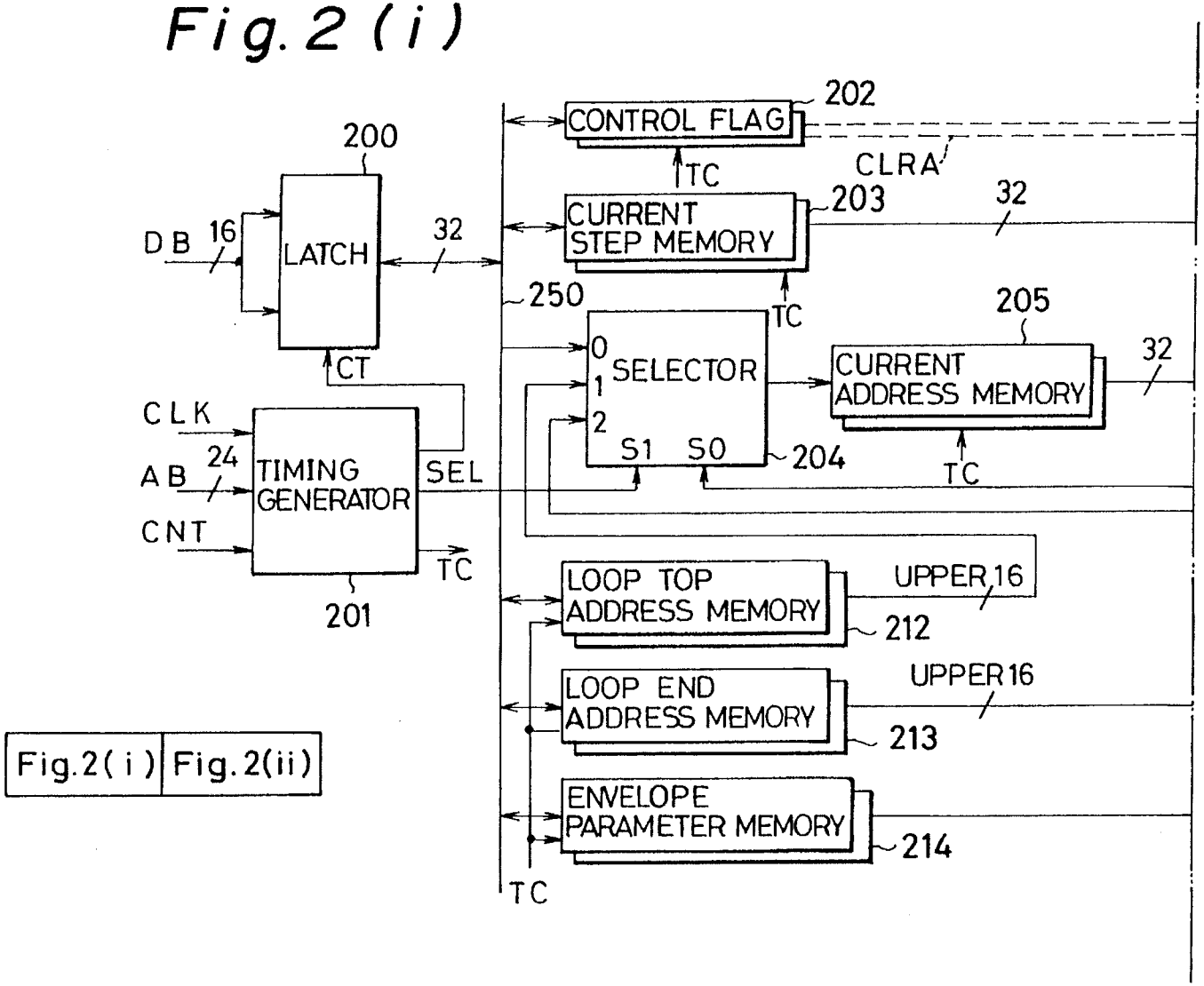
FIG. 2(*i*) and FIG. 2(*ii*) are block diagrams of a tone source circuit in Example 1 for a musical tone signal generating apparatus of the present invention.

FIG. 2 is a block diagram of the tone source circuit in Example 1, adapted for the musical tone signal generating apparatus of the present invention. The tone source circuit includes the above decoding circuit 209. The hardware and operation of the tone source circuit will be explained in detail below with reference to the block diagram in FIG. 2.

The readout means in the present invention is made up of a current step memory 203, a selector 204, a current address memory 205, an adder 206, a loop top address memory 212, a loop end address memory 213 and a comparator 211. The readout means generates a wave readout addresses.

In FIG. 2, the CPU and the tone source circuit are connected through a 16-bit data bus DB, a 24-bit address bus AB and a control data bus CNT. A latch 200 is a bi-directional 3-state latch. The latch 200 is used for controlling the transmission and reception of data between the CPU and the tone source circuit. The tone source circuit handles 32-bit width data, so that the transmission of data from the CPU to the tone source circuit is carried out twice, 16 bits each. The latch 200 consecutively takes 16-bit data from the data bus DB, and when data comes up to 32 bits, it transmits the data to an internal bus 250. Conversely, when data is transmitted from the tone source circuit to the CPU, 32-bit data is set in the latch 200. The data set in the latch 200 is outputted to the data bus DB twice, 16 bits each. The latch-timing and transmission directions of the latch 200 are carried out by a control signal CT from a timing generator 201.

The timing generator 201 receives a clock signal CLK from a clock generator (not shown), address data transmitted from the CPU through the address bus AB and control data transmitted from the CPU through the control data bus CNT, and generates various control signals for controlling each portion of the tone source circuit. Specifically, the timing generator 201 generates the control signal CT for controlling the latch 200, a control signal SEL for controlling the selector 204 and the timing signal TC for designating one time slot. For example, when the tone source circuit is operated with time-sharing of 32 tone generating channels, the timing signal TC is used for designating one of 32 time slots. The timing signal TC is supplied to various memories, etc., to be described later.

The control flag latch 202 has a time-sharing constitution and stores data from the CPU. A clear signal CLRA output from a predetermined bit of the control flag latch 202 is supplied to a clear circuit 207. The clear signal CLRB outputted from other bit is supplied to the clear circuit 105 (see FIG. 1). The musical tone signal generating apparatus having no clear circuit 105 and no clear circuit 207 to be described later requires no control flag latch 202.

The current step memory 203 has a time-sharing constitution, and stores F number from the CPU. The term "F number" is data defining a pitch (frequency) of a musical tone to be generated. Specifically, F number is used to increment the value of the wave readout address when the wave data of the wave data group is consecutively read out from the wave memory 208. F number from the current step memory 203 is supplied to an input terminal A of the adder 206.

The selector 204 has three input ports (port 0, port 1 and port 2). Each input port is selected depending upon control signals supplied to control input terminals S0 and S1. Only 16 bits data is supplied to the port 1. When the port 1 is selected, therefore, data of 32 bits produced by replacing to the lower 16 bits with "0" is outputted from the selector 204. The following Table 1 shows the relation between control signals (S0, S1) and an input port to be selected.

TABLE 1

| <S1> | <S0> | <Input port to be selected> |
|---|---|---|
| 0 | 0 | port 2 (subsequent wave readout address) |
| 0 | 1 | port 1 (loop top address LT) |
| 1 | — | port 0 (data transmitted,from CPU) |

The port 0 is used for selecting one wave data group from a plurality of the wave data groups. Each of the wave data groups corresponds to each of timbres. The CPU transmits control data to the timing generator 201 for generating the control signal SEL. At the same time, the CPU transmits a beginning address (a start address SA) of the wave data group for a desired timbre to the latch 200 through the data bus DB. The port 0 is selected based on the control signal SEL so that the start address SA of the wave data group is output from the selector 204. As a result, the initial value of the wave readout address of the wave data group is determined. The port 1 is used for returning from the loop end address LE of the repeat portion of the wave data group to the loop top address LT. The port 2 is used for a purpose other than the above, i.e., for consecutively generating the subsequent wave readout address. The data selected in the selector 204 is supplied to the current address memory 205.

The current address memory 205 has a time-sharing constitution, and stores a current wave readout address. The current wave readout address stored in the current address memory 205 indicates a storage site (location) of the wave data of the wave data group to be read out. The integer portion of the current wave readout address from the current address memory 205 is supplied to an input terminal B of the adder 206 and an input terminal B of the comparator 210.

The adder 206 adds F number from the current step memory 203 to the current wave readout address. The output of the adder 206 is a subsequent wave readout address. The integer portion of the subsequent wave readout address indicates a storage site (location) of the wave data of the wave data group which will be read out in the next cycle. The output of the adder 206 is supplied to the clear circuit 207.

The clear circuit 207 is used for bringing the predetermined bit in the lower order of the subsequent wave readout address from the adder 206 to zero. The clear circuit 207 is required when the predetermined bit in the lower order of the wave readout address from the CPU includes invalid data. The clear circuit 207 may therefore be omitted when 32-bit valid data is transmitted from the CPU. The output of the clear circuit 207 is supplied to the wave memory 208 (upper 16 bits), the input terminal A of the comparator 210 (upper 16 bits), an input terminal A of the comparator 211 (upper 16 bits) and the port 2 of the selector 204 (32 bits).

As described above, the wave memory 208 stores a plurality of the differential wave data $\Delta WD_n$ of ADPCM format and the specific wave data $W_j$ of PCM format. The content in the wave memory 208 is read out according to the integer portion of the subsequent wave readout address from the clear circuit 207. That is, a musical tone signal is generated on the basis of the specific wave data $W_j$ or the differential wave data $\Delta WD_n$ related to the integer portion of the current wave readout address stored in the current address memory 205, and at the same time, the specific wave data $W_{j+1}$ or the differential wave data $\Delta WD_{n+1}$ is read out from the wave memory 208. The specific wave data $W_{j+1}$ or the differential wave data $\Delta WD_{n+1}$ from the wave memory 208 is supplied to the decoding circuit 209 in the next cycle. The sampling data $YD_j$ or $YD_n$ obtained by generation or accumulation in the decoding circuit 209 is supplied to the input terminal A of the multiplier 217.

The comparator 210 compares the integer portion of the current wave readout address from the current address memory 205 and the integer portion of the subsequent wave readout address from the clear circuit 207. When these are in agreement, the comparator 210 outputs "1". When these are not in agreement, the comparator 210 outputs "0". The output of the comparator 210 as the identity signal CF is supplied to the gate 102 of the decoding circuit 209. The gate 102 is provided for preventing duplicate addition of the differential wave data $\Delta WD_n$ to the sampling data $YD_{n-1}$. The possibility of the duplicate addition takes place when the interval for reading out the wave data of the wave data group for reproducing low-pitched sound is decreased, namely when the value of the integer portion does not change even if the wave readout address is incremented.

The loop top address memory 212 has a time-sharing constitution, and stores the loop top addresses LT for a plurality of the wave data groups. The loop top address LT from the loop top address memory 212 is supplied to the port 1 of the selector 204.

The loop end address memory 213 has a time-sharing constitution, and stores the loop end addresses LE for a plurality of the wave data groups. The loop end address LE from the loop end address memory 213 is supplied to an input terminal B of the comparator 211.

The comparator 211 constantly compares the integer portion (upper order 16 bits) of the subsequent wave readout address and the loop end address LE (upper order 16 bits) from the loop end address memory 213 for detecting an end of the repeat portion. And, a signal indicating the comparison result is transmitted to the control input terminal S0 of the selector 204. As a result, when the integer portion of the subsequent wave readout address matches the loop end address LE, the port 1 of the selector 204 is selected, whereby the loop top address LT (upper 16 bits) from the loop top address memory 212 and value of zero (lower 16 bits) are stored in the current address memory 205. On the other hand, when the integer portion of the subsequent wave readout address does not match the loop end address LE, the port 2 of the selector 204 is selected, whereby the subsequent wave readout address is stored in the current address memory 205. By the above operation, the function of repeatedly reading out the repeat portion of the wave data group is achieved.

An envelope parameter memory 214 has a time-sharing constitution, and stores a current envelope target value, an envelope addition value and a loudness value. The content of the envelope parameter memory 214 is read out by an envelope generator 215. A current envelope memory 216 has a time-sharing constitution, and stores a current envelope value which is an intermediate result of envelope operation.

The musical tone signal generating means of the present invention is constituted by the envelope generator 215 and a multiplier 217.

The envelope generator 215 adds the envelope addition value from the envelope parameter memory 214 to a current envelope value from the current envelope memory 216, with time-sharing. And then, the envelope generator 205 determines whether or not the operation result reaches the target value in the envelope parameter memory 214. When the operation result is not reached, the operation result is stored in the current envelope memory 216 as a new current envelope value for the subsequent operation. The operation result is also multiplied with a loudness value, and the multiplication result is outputted from the envelope generator 215 as envelope level EL. In this manner, the envelope generator 215 generates an envelope which gradually asymptotically reaches the envelope target value. The envelope level EL from the envelope generator 215 is supplied to an input terminal B of the multiplier 217.

The multiplier 217 multiplies the sampling data $YD_j$ or $YD_n$ from the decoding circuit 209 and the envelope level EL from the envelope generator 215. This multiplication forms a musical tone signal to which the envelope is added. The musical tone signal from the multiplier 217 is supplied to an adder system 218.

The adder system 218 allocates all of tone generating channels to at least one of four timbre systems, and adds the musical tone signal in each timbre system. The output of the adder system 218 is supplied to a digital control filter 219.

As the digital control filter 219, for example, there can be used a digital filter which operates by 8 times over-sampling. The output of the digital control filter 219 is supplied to a D/A converter 220. The D/A converter 220 converts a digital signal obtained by the above over-sampling to an analog signal for each timbre system. The analog signal is supplied to a speaker or an earphone through an amplifier (not shown).

As explained above, according to Example 1, when the specific wave data $W_j$ (stored in the wave memory 208 as "8000H" in PCM format) is read out from the wave memory 208, the sampling data $YD_{n-1}$ so far obtained by the accumulation is discarded, and the accumulation is resumed from the sampling data $YD_j$. As a result, an accumulation error inherent to the ADPCM or DPCM method can be removed. Further, an accumulation error at a non-repetitive readout can be also removed.

When a musical tone wave is sampled at a predetermined cycle, it is considered that there is no specific sampling data $D_j$ (j=0) at the sampling point In this case, the position where the sampling starts can be slightly shifted so as to obtain the specific sampling data $D_j$ (j=0) the content of which is zero.

The wave memory 208 can store a plurality of the wave data groups for a plurality of timbres, each wave data group including the specific wave data $W_j$ and a plurality of the differential wave data $\Delta WD_n$, and the content of the specific sampling data $D_j$ related to the specific wave data $W_j$ in each wave data group is preferably identical.

In Example 1, the specific wave data $W_j$ is stored in the wave storage means of location designated by j=M=128. That is, the content of the wave memory 208 designated by the loop top address LT is the specific wave data $W_j$. Alternatively, the differential wave data $\Delta WD_{n-1}$ is obtained by deducting sampling data $D_{N-2}$ from sampling data $D_{M-1}$ ($1 \leqq M \leqq N-3$), and the number of "j" satisfies the relation of $M<j<N-1$, and the readout means reads out the differential wave data $\Delta WD_M$ again, after the readout means reads out the differential wave data $\Delta WD_{n-1}$. In this case, the value of "M" is the loop top address and the value of "N" is the loop end address.

EXAMPLE 2

Example 2 is directed to the preferred embodiment of the musical tone signal generating apparatus of the present invention. The musical tone signal generating apparatus of Example 2 generates a musical tone signal with carrying out interpolation of the sampling data. In Example 2, the differential wave data $\Delta WD_n$ of DPCM format and the specific wave data $W_j$ of PCM format are used, and the content of the specific sampling data $D_j$ is within a predetermined extent.

As shown in FIG. 8A, the specific wave data $W_j$ and the differential wave data $\Delta WD_n$ are 16-bit data of a 2's complement, having a sign in the most significant bit (bit 15). The specific wave data $W_j$ and the differential wave data $\Delta WD_n$ are produced in the same manner as explained with reference to FIG. 4. In this case, when the content of the sampling data is within the a predetermined extent, for example, range of ±256, the following processing is carried out. That is, when such sampling data (the specific sampling data $D_j$) is a positive number, the lower byte (bits 0–7) is retained intact, and the upper byte (bits 8–14) excluding the sign bit is set as all "1". When such sampling data (the specific sampling data $D_j$) is a negative number, the lower byte (bits 0–7) is retained intact, and the upper byte (bits 8–14) excluding the sign bit is cleared to all "0". The so-processed data is the specific wave data $W_j$ of PCM format.

The differential wave data $\Delta WD_n$ (DPCM format) is obtained in the same manner as Example 1 and the specific wave data $W_j$ (PCM format) are stored in locations of a wave memory 316 designated by integer addresses to be described later.

The wave data group stored in the wave memory 316 are handled as shown in FIG. 8B when generating or reproducing the sampling data $YD_j$ or $YD_n$. That is, out of positive integers, "0000H~7EFFH (+0000H~+7EFFH)" are handled as the differential wave data $\Delta WD_n$, while "7F00H~7FFFH (+7F00H~+7FFFH)" are handled as the specific wave data $W_j$. The content "7F00H~7FFFH" of the specific wave data $W_j$ is converted to PCM data "0000H~00FFH (+0000H~+00FFH)" as shown in FIG. 8C(X) to generate the sampling data $YD_j$. Similarly, out of negative integers, "FFFFH~8100H (−0001—7F00H)" are handled as the differential wave data $\Delta WD_n$, while "80FFH~8000H (−7F01H—8000H)" are handled as the specific wave data $W_j$. The content "80FFH~8000H" of the specific wave data $W_j$ is converted to PCM data "FFFFH~FF00H (−0001H—0100H)" as shown in FIG. 8C(Y) to generate the sampling data $YD_j$. The above parenthesized values are signed hexadecimal absolute value.

(1) Explanation of Decoding Circuit

Figure 6:
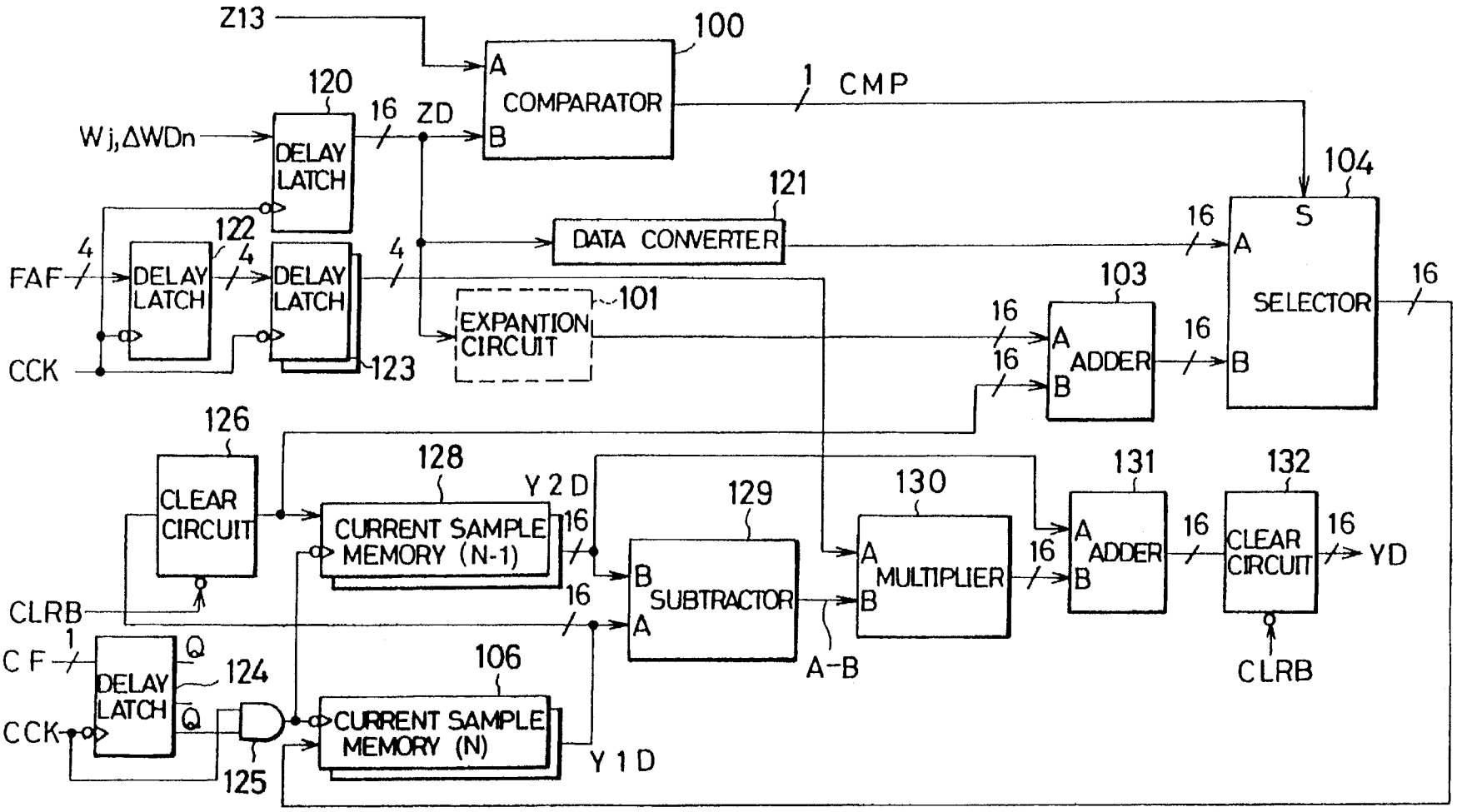
FIG. 6 is a block diagram of a decoding circuit adapted for a tone source circuit in Example 2 for a musical tone signal generating apparatus of the present invention.

FIG. 6 is a block diagram of a decoding circuit 317 (see FIG. 7) adapted for a tone source circuit for the musical tone signal generating apparatus of the present invention. The decoding circuit 317 corresponds to the decoding means including interpolating means, and the temporary storage means. In FIG. 6, components or members which are the same as, or similar to, those of the decoding circuit shown in FIG. 1 are shown by the same numerals.

Figure 11:
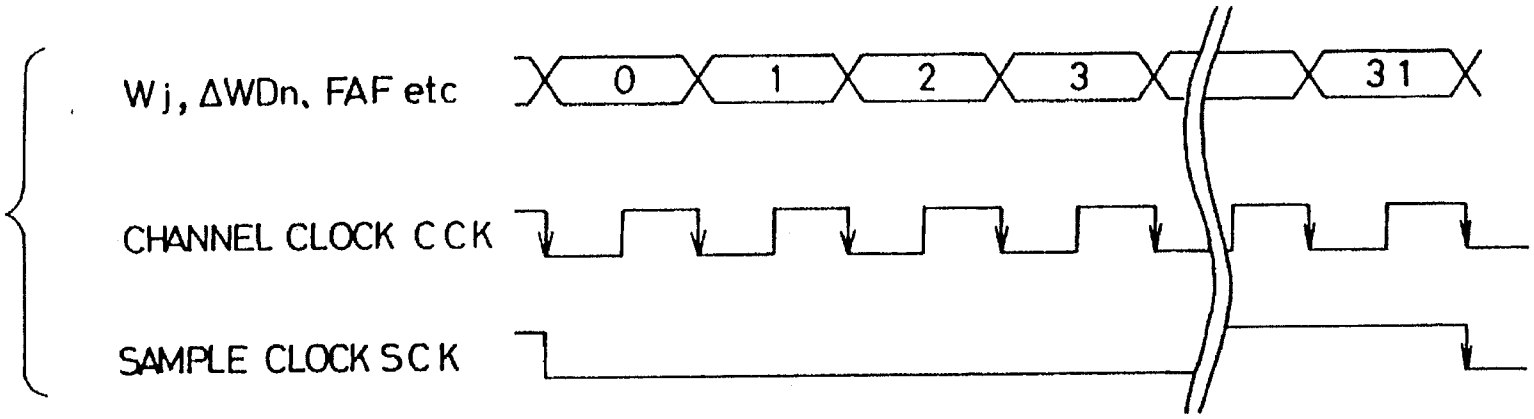
FIG. 11 is a timing chart for the operation timing of a decoding circuit in Example 2 for a musical tone signal generating apparatus of the present invention.
Figure 12:
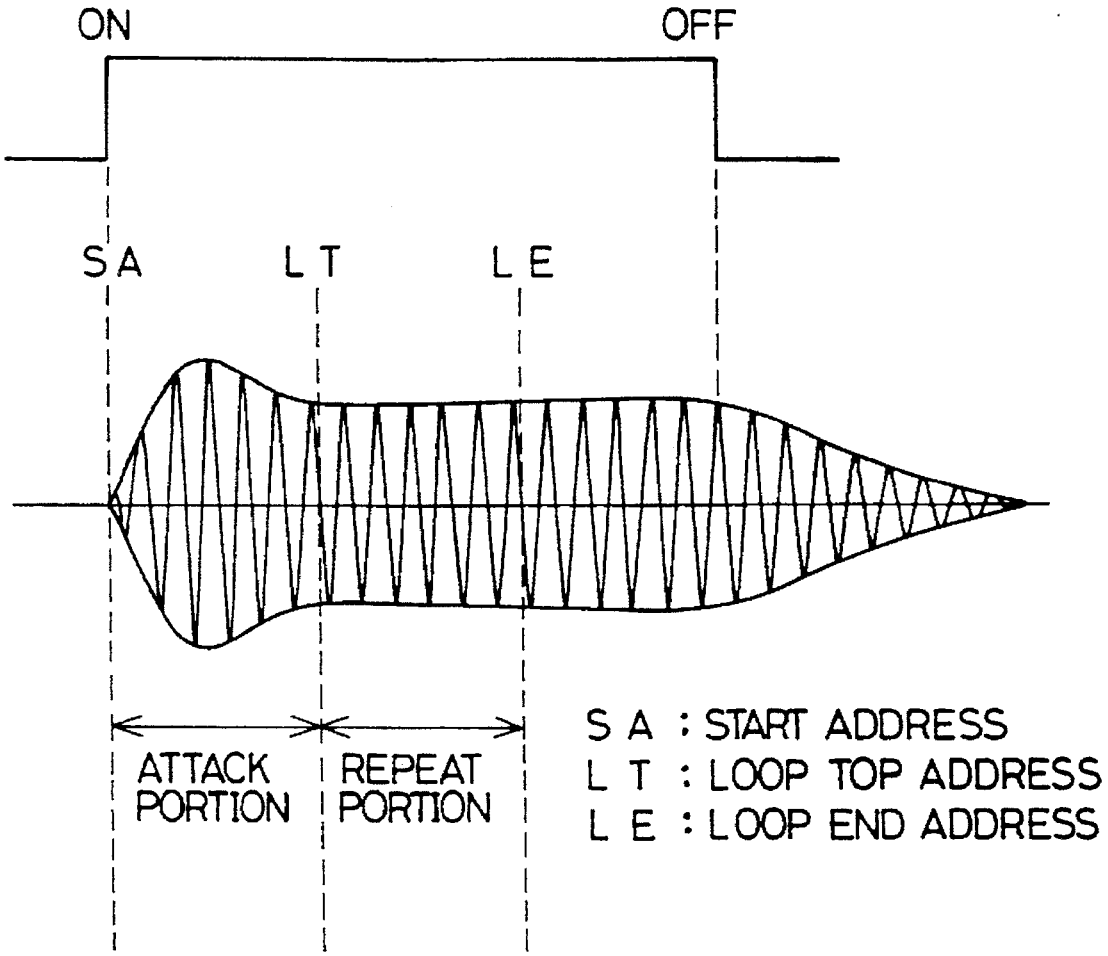
FIG. 12 schematically shows an example of the storage of differential wave data in a wave memory in Example 1 and 2 for a musical tone signal generating apparatus of the present invention.

In FIG. 6, delay latches 120, 122, 123 and 124 are provided for pipe line control. These delay latches latch input data synchronously with a channel clock CCK. The channel clock CCK, as shown in FIG. 11, refers to a clock which defines the time slot corresponding to each tone generating channel. The tone generating channel is switched at a trailing edge of the channel clock CCK. Further, a sampling clock SCK is a clock having the trailing edge each time when the channel clock CCK counts the time slots corresponding to all the tone generating channels. The processing of the sampling data, etc., are carried out synchronously with the sampling clock SCK.

The delay latch 120 stores the wave data of the wave data group from a wave memory 316 synchronously with the channel clock CCK. The wave memory 316 corresponds to the wave storage means. The wave data of the wave data group from the delay latch 120, is supplied to the input terminal B of the comparator 100, a data converter 121 and the input terminal A of an adder 103.

The range value Z13 which can be stored in a ROM or a register (not shown) is supplied to the comparator 100. The comparator 100 compares the content of the wave data of the wave data group with the range value Z13. The range value Z13 has an extent which coincides with the range which the content of the specific wave data $D_j$ takes. That is, the maximum of the range value Z13 is 7FFFH and FFFFH, and the minimum is 7F00H and FF00H.

When the wave data, the content of which is within the range value Z13, enters the comparator 100, the comparator 100 detects the specific wave data $W_j$ and outputs a control signal CMP of "1". When the wave data, the content of which is without the range value Z13, enters the comparator 100, the comparator 100 detects the differential wave data $\Delta WD_n$ and outputs the control signal CMP of "0". The control signal CMP is supplied to the input terminal S of the selector 104.

The data converter 121 converts the wave data of the wave data group from the delay latch 120 by a method shown in FIG. 8C. That is, when the wave data of the wave data group is a positive number, the lower byte is retained intact, and the upper byte is set as "00H". When it is a negative number, the lower byte is retained intact, and the upper byte is set as "FFH". As a result, the specific wave data $W_j$ is restored to the same PCM data (the content of the specific wave data $W_j$ being a value in the range of±256) as or similar to that of the specific sampling data $D_j$. The output of the data converter 121 is supplied to the input terminal A of the selector 104. The differential wave data $\Delta WD_n$ is converted to data which content is a strange value but such a converted data will be discarded in the selector 104.

The expansion circuit 101 is optional. That is, in Example 2, the differential wave data $\Delta WD_n$ to be stored in the wave memory 316 are of DPCM format, so that the expansion circuit 101 is not required. When the differential wave data $\Delta WD_n$ of ADPCM format are stored in the wave memory 316, it is sufficient to insert the expansion circuit 101 in a site shown in FIG. 6. The same expansion circuit that used in Example 1 can be used as the expansion circuit 101 in Example 2.

The first current sample memory 106 and a second current sample memory 128 have a time-sharing constitution, and correspond to the temporary storage means of the present invention. The first current sample memory 106 stores the sampling data $YD_{n-1}$ so far accumulated.

The sampling data $YD_{n-1}$ is supplied to a clear circuit 126. The clear circuit 126 outputs zero when the clear signal CLRB from the tone source circuit (to be described later) is activated. If the above is not the case, the clear circuit 126 directly passes the sampling data $YD_{n-1}$. The output (zero or the sampling data $YD_{n-1}$) of the clear circuit 126 is supplied to the second current sample memory 128 and the input terminal B of the adder 103. The clear signal CLRB is activated when the readout of the wave data of the wave data group is initiated, i.e., a key-ON event occurs, whereby the content of the second current sample memory 128 is cleared to zero.

The second current sample memory 128 stores the sampling data $YD_{n-1}$ from the current sample memory 106. The writing in the second current sample memory 128 is carried out synchronously with the channel clock CCK except for a case when a specific condition (to be described later) is satisfied. Therefore, the content ($YD_{n-1}$) of the first current sample memory 106 is stored in the second current sample memory 128 while delayed by 1 channel clock. The sampling data $YD_{n-1}$ from the current sample memory 128 is supplied to the input terminal B of the subtractor 129 and the an adder 131.

The adder 103 adds the differential wave data $\Delta WD_n$ or the specific wave data $W_j$ from the delay latch 120 to the sampling data $YD_{n-1}$ transmitted from the first current sample memory 106 (to be described later) through the clear circuit 126. The output of the adder 103 makes the sampling data $YD_n$. The adder 103 realizes the function of accumulating the differential wave data $\Delta WD_n$. The obtained sampling data from the adder 103 is supplied to the input terminal B of the selector 104.

The selector 104 selects one of the converted data from the data converter 121 and the sampling data $YD_n$ from the adder 103, according to the control signal CMP from the comparator 100. More specifically, when the control signal CMP is "1", the input terminal A of the selector 104 is selected, whereby the converted data from the data converter 121, i.e., "7F00H~7FFFH (+7F00H~+7FFFH)" or "80FFH~8000H (−7F01H—8000H)" is outputted as the sampling data $YD_j$ and supplied to the first current memory 106. On the other hand, when the control signal CMP is "0", the input terminal B of the selector 104 is selected, whereby the data from the adder 103, i.e., the obtained sampling data $YD_n$ is outputted and supplied to the current sample memory 106.

The writing into the first current sample memory 106 is carried out synchronously with the channel clock CCK except for a case when a specific condition (to be described later) is satisfied. The sampling data $YD_n$ from the first current sample memory 106 is supplied to the subtractor 129.

The writing in the first and second current sample memories 106 and 128 are carried out synchronously with a write signal produced by the delay latch 124 and an AND gate 125. The delay latch 124 includes a D-type flip-flop having an inversion output terminal. The delay latch 124 latches the identity signal CF synchronously with the channel clock CCK and supplied a signal from the inversion output terminal to the AND gate 125. When the identity signal CF is "0", the channel clock CCK is supplied to the first and second current sample memories 106 and 128 through the AND gate 125, whereby not only the sampling data $YD_{n-1}$ retained in the first current sample memory 106 is written in the second current sample memory 128, but also the output ($YD_n$ or $YD_j$) of the selector 104 is written in the first current sample memory 106. On the other hand, when the identity signal CF is "1", the channel clock CCK is masked with the AND gate 125, and nothing is written in the first and second current sample memories 106 and 128.

The identity signal CF is generated in the tone generating circuit to be described later. The identity signal CF is set as "1", when the wave readout address having the same value in its integer portion is outputted continuously twice or more, and the identity signal CF is cleared to "0", when the above is not the case. When the identity signal CF is set as "1", therefore, the writing in the first and second current sample memories 106 and 128 is inhibited in the time slot after 1 channel clock.

The interpolating means of the present invention includes of the subtractor 129, a multiplier 130 and the adder 131, which are used for calculating the interpolation value of the sampling data between the sampling data $YD_{j+1}$ and $YD_j$ or between the sampling data $YD_{n+1}$ and $YD_n$. The subtractor 129 deducts the content of the second current sample memory 128 ($YD_j$ or $YD_n$) from the content of the first current sample memory 106 ($YD_{j+1}$ or $YD_{n+1}$), whereby a differential value between the two sampling data is calculated. The output of the subtractor 129 is supplied to the input terminal B of the multiplier 130.

A fraction address (to be detailed later), which delays by 2 channel clocks in the delay latches 122 and 123, is supplied to the input terminal A of the multiplier 130. The multiplier 130 multiplies the fraction address and the differential value from the subtractor 129. The output of the multiplier 130 constitutes an interpolation value and is supplied to the input terminal B of the adder 131. The sampling data $YD_n$ or $YD_j$ from the second current sample memory 128 is supplied to the input terminal A of the adder 131. Therefore, the adder 131 carries out the addition, so that the interpolated sampling data YD is generated. The output (YD) of the adder 131 is supplied to a clear circuit 132.

The clear circuit 132 outputs zero when the clear signal CLRB from a control flag latch 302 of the tone source circuit (to be described later) is activated, and it directly passes the output (the interpolated sampling data YD) of the adder 131 when the above is not the case. The output of the clear circuit 132 is supplied to a multiplier 326 of the tone source circuit (see FIG. 7) as the interpolated sampling data YD for generating a musical tone signal. As described above, the clear signal CLRB is activated when the readout of the differential wave data $\Delta WD_n$ or the specific wave data $W_j$ is initiated, i.e., when a key-ON event occurs, whereby the output of unfixed interpolated sampling data is prevented.

As explained above, the present decoding circuit internally stores the sampling data $YD_n$, so that, unlike a conventional case, it is not required to constantly read out the sampling data in two sampling points. That is, the interpolation can be performed by only reading the wave data of the wave data group from the wave memory 316. The circuit constitution is therefore simplified. Further, the time of the time slot corresponding to one tone generating channel can be decreased, which leads to the achievement of the musical tone signal generating apparatus which permits the processing at a higher rate.

(2) Explanation of Tone Source Circuit

Figures 7, 7I:
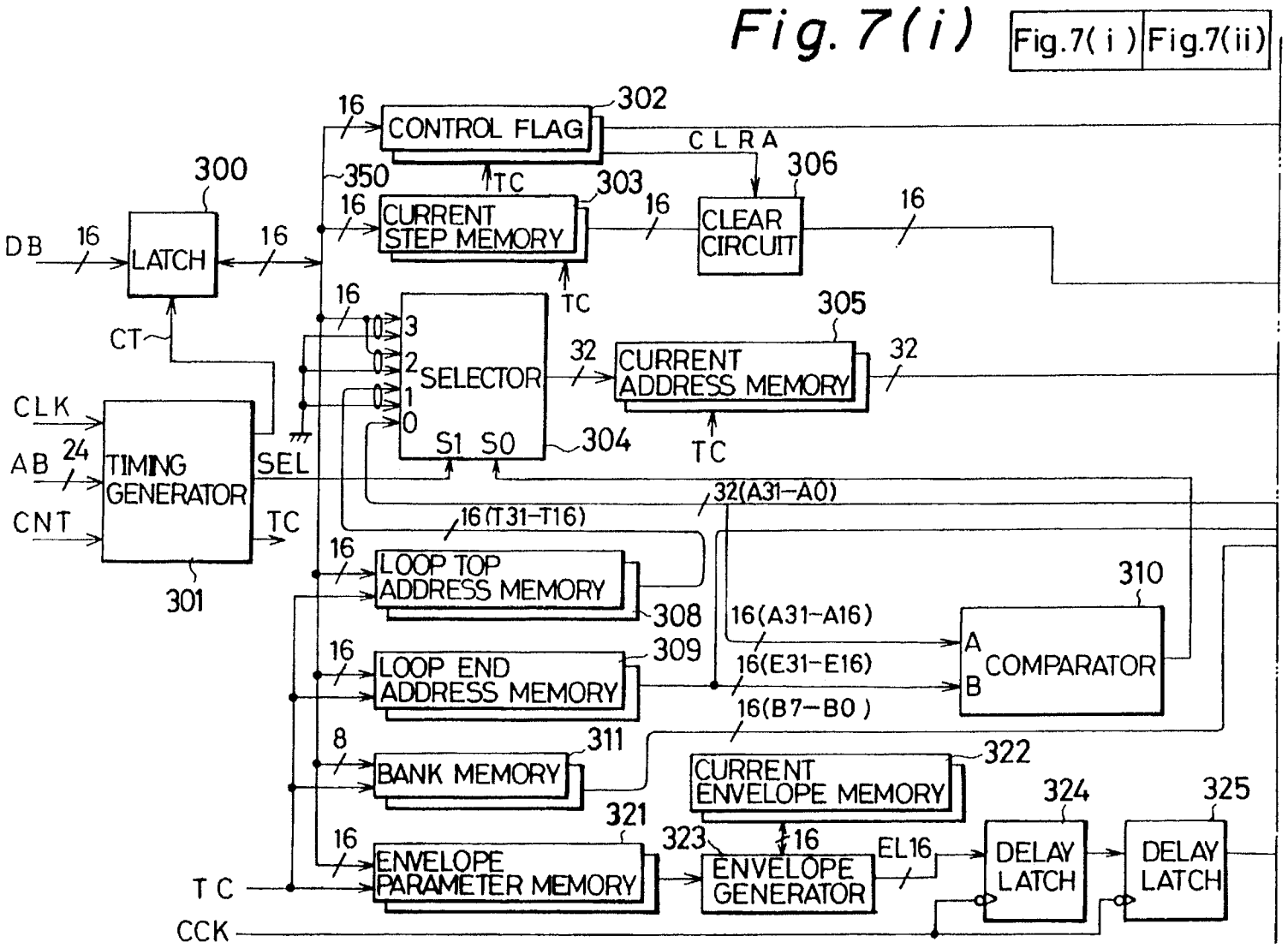
FIG. 7(*i*) and FIG. 7(*ii*) are block diagrams of a tone source circuit in Example 2 for a musical tone signal generating apparatus of the present invention.

FIG. 7 is a block diagram of the tone source circuit adapted for the musical tone signal generating apparatus of the present invention. For the tone source circuit, the above decoding circuit 317 is adapted. The constitution and operation of the tone source circuit will be explained in detail below with reference to the block diagram in FIG. 7.

The readout means of the present invention includes F number generating means, F number accumulating means, a bank memory 311, an OR gate 312, an adder 313, a comparator 314 and a selector 315. The F number generating means includes a current step memory 303 and a clear circuit 306. The F number accumulating means includes a selector 304, a current address memory 305, an adder 307, a loop top address memory 308, a loop end address memory 309 and a comparator 310.

Figure 10:
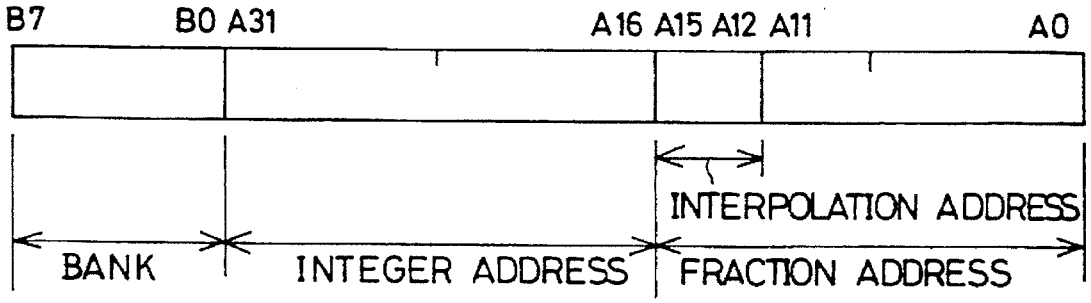
FIG. 10 schematically shows a wave readout address used in Example 2 for a musical tone signal generating apparatus of the present invention.

The format of the wave readout address for reading out the wave data of the wave data group from the wave memory 316 will be first explained below with reference to FIG. 10. As shown in FIG. 10, the wave readout address includes 32-bit data. The wave readout address has an integer portion and a fraction portion. The lower 16 bits (A15–A0) of the wave readout address are used as a fraction address (a fraction portion) and used as an interpolation address. Example 2 uses 4 bits (A15–A12) as the interpolation address, while any value in the range of 1 to 16 bits may be used as required.

The upper 16 bits (A31–A16) of the wave readout address corresponding to the integer portion (an integer portion) and a bank address (B7–B0) form addresses actually designating locations in the wave memory 316. The wave memory 316 includes 256 banks, each of which has 64K bytes. The bank address is used for selecting one out of the 256 banks. The integer address is used for designating the locations of the differential wave data $\Delta WD_n$ or the specific wave data $W_j$ in the bank.

A loop top address LT includes 16 bit data. The loop top address LT corresponds to the integer portion of the wave readout address. A loop end address LE includes 16 bit data. The loop end address LE corresponds to the integer portion of the wave readout address. The loop top address LT is used to designate a beginning portion of a repeat portion of the wave data group. The loop end address LE is used to detect the ending portion of the wave data group.

In FIG. 7, the CPU and the tone source circuit are connected to each other through the 16-bit data bus DB, the 24-bit address bus AB and the control data bus CNT. A latch 300 is a bi-directional 3-state latch. The latch 300 is used for controlling the transmission and reception of data between the CPU and the tone source circuit. The latch 300 takes 16-bit data from the data bus DB, and outputs it to an internal bus 350. Further, the latch 300 takes 16-bit data from the internal bus 350, and outputs it to the CPU. The latch-timing and transmission directions of the latch 300 are controlled on the basis of the control signal CT transmitted from a timing generator 301.

Like the timing generator 201 in Example 1, the timing generator 301 generates various control signals for controlling various portions of the tone source circuit. Specifically, the timing generator 301 generates the control signal CT for controlling the latch 300, the control signal SEL for controlling the selector 304 (to be described later) and the timing signal TC for designating one tone generating channel. These signals have characteristics similar to those in Example 1.

The control flag latch 302 has a time-sharing constitution, and stores data transmitted from the CPU. The clear signal CLRA outputted from a predetermined bit of the control flag latch 302 is supplied to the clear. circuit 306. Clear signal CLRB outputted from the other bit is supplied to the clear circuits 126 and 132 (see FIG. 6).

The current step memory 303 has a time-sharing constitution, and stores F number. The current step memory 303 corresponds to the F number generating means of the present invention. The F number to be stored in the current step memory 303 is obtained from the CPU according to key-ON information. The F number from the current step memory 303 is supplied to the clear circuit 306.

The clear circuit 306 outputs zero when the clear signal CLRA from the control flag latch 302 is activated, and it directly passes the F number from the current step memory 303 when the above is not the case. The output of the clear circuit 306 is supplied to the input terminal A of the adder 307. Meanwhile, generally, the clear signal CLRA is controlled such that it is active only for first one time slot when the readout of the wave data of the wave data group from the wave memory 316 is initiated (see FIG. 9). In an initial state, therefore, the input terminal A of the adder 307 has zero inputted. Therefore, the adder 307 directly outputs the content of the current address memory 305, whereby, in the initial state, the readout of the wave data of the wave data group can be started with using the specific wave readout address.

The selector 304 has four input ports (port 0, port 1, port 2 and port 3). These input ports are selected according to control signals supplied to the control input terminals S0 and S1. Only 16-bit data is supplied to the ports 1 to 3. When one of these ports is selected, therefore, data of 32 bits produced by replacing to the lower 16 bits with "0" is output from the selector 304. On the other hand, 32-bit data is supplied to the port 0, and when this port is selected, 32-bit data which has been inputted is therefore directly outputted. The relation between control signals (S0, S1) and the input port to be selected is as follows.

TABLE 2

| <S1> | <S0> | <Input port to be selected> |
|---|---|---|
| 0 | 0 | port 0 (subsequent wave readout address) |
| 0 | 1 | port 1 (loop top address LT) |
| 1 | 0 | port 2 (data from CPU) |
| 1 | 1 | port 3 (data from CPU) |

The ports 2 and 3 are used for selecting one wave data group out of a plurality of the wave data groups. That is, the CPU not only transmits to the timing generator 301 control data for generating the control signal SEL, but also transmits a beginning address (an integer portion of the start address SA) of the wave data group for a desired timbre to the latch 300 through the data bus DB. The port 0 is selected based on the control signal SEL, and the selector 304 outputs the wave readout address. The port 1 is used for returning from the loop end address LE of the repeat portion of the wave data group to the loop top address LT. When the port 1 is selected, the selector 304 outputs the 32-bit loop top address LT (integer address+fraction address (0)). The port 0 is used for a purpose other than the above, i.e., for reading out the wave data of the wave data group while consecutively renewing the wave readout address. When the port 0 is selected, the selector 304 outputs the 32-bit subsequent wave readout address (integer address+fraction address). The data selected in the selector 304 is supplied to the current address memory 305.

The current address memory 305 has a time-sharing constitution, and stores the current wave readout address. The current wave readout address from the current address memory 305 is supplied to the input terminal B of the adder 307.

The adder 307 adds F number from the clear circuit 306 to the current wave readout address. The result of this addition is used as the subsequent wave readout address. The output of the adder 307 is supplied to the port 0 (A31–A0) of the selector 304, the OR gate 312 (A15–A12), the input terminal B (A31–A16) of the adder 313 and the delay latch 122 (A15–A12) of the decoding circuit 317.

The interpolation address (A15–A12) of the wave readout address from the adder 307 is supplied to the OR gate 312. The OR gate 312 performs logical 0R operation. When the interpolation address is not zero, therefore, "1" is outputted from the OR gate 312 to the input terminal A of the adder 313.

The adder 313 adds the output of the OR gate 312 to the integer address (A31–A16). The OR gate 312 and the adder 313 achieves the function of incrementing (+1) the integer address (A31–A16) when the interpolation address is not zero. As a result, the subsequent wave readout address for interpolation can be obtained. The output of the adder 313 is supplied to the input terminal A of the comparator 314 and the input terminal B of the selector 315.

The loop end address LE from the loop end address memory 309 (to be described later) is supplied to the input terminal B of the comparator 314. In the comparator 314, therefore, the integer portion of the subsequent wave readout address and the loop end address LE are compared. When the comparison result is that the above two are identical, "1" is outputted. Otherwise, "0" is outputted. The output of the comparator 314 is supplied to the input terminal S of the selector 315 as a control signal.

The selector 315 selects one of the loop top address LT (T31–T16) from the loop top address memory 308 (to be described later) or the integer portion of the subsequent wave readout address from the adder 313, according to the control signal from the comparator 314. When "1" is supplied to the input terminal S of the selector 315, the input terminal A of the selector 315 is selected to output the loop top address LT. On the other hand, when "0" is supplied to the input terminal S of the selector 315, the input terminal B of the selector 315 is selected to output the integer portion of the subsequent wave readout address. The output of the selector 315 is supplied to the wave memory 316 as the wave readout address (A31–A16), and it is also supplied to a delay latch 318 and the input terminal A of a comparator 319. The above constitution achieves the function of returning to the loop top address LT when the integer portion of the subsequent wave readout address matches the loop end address LE.

The delay latch 318 has a time-sharing constitution, and latches the bank address and the integer portion of the subsequent wave readout address from the selector 315 synchronously with the channel clock CCK. The delay latch 318 is used for storing the bank address and the integer portion of the subsequent wave readout address until after 1 channel clock. The output of the delay latch 318 is supplied to the input terminal B of the comparator 319.

The comparator 319 compares the output of the selector 315 and the output of the delay latch 318. When the two are identical, "1" is output. Otherwise, "0" is output. The output of the comparator 319 is supplied to a clear circuit 320.

The clear circuit 320 outputs zero when the clear signal CLRB from the control flag latch 302 is activated. It directly passes the output of the comparator 319 when the above is not the case. The output of the clear circuit 320 is supplied to the delay latch 124 of the decoding circuit 317 as the identity signal CF. The clear signal CLRB is controlled so as to be active for the beginning 2 time slots when the readout of the wave data of the wave data group is initiated (see FIG. 9). For the beginning 2 time slots, the identity signal CF is forced to be "0", whereby the malfunction of the tone source circuit is avoided.

The wave memory 316 corresponds to the wave storage means of the present invention. As already described, the wave memory 316 stores the differential wave data $\Delta WD_n$ of DPCM format and the specific wave data $W_j$ of PCM format. The content of the wave memory 316 is read out according to the integer portion of the wave readout address from the selector 315 and the bank address from the bank memory 311 to be described later. The wave data of the wave data group read out from the wave memory 316 is supplied to the decoding circuit 317.

The sampling data YD from the decoding circuit 317 is supplied to the input terminal A of the multiplier 326.

The loop top address memory 308 has a time-sharing constitution, and stores the loop top address LT of each of a plurality of wave data groups each of which corresponds to each timbre. The loop top address LT from the loop top address memory 308 is stored in the current address memory 305 through the port 1 of the selector 304.

The loop end address memory 309 has a time-sharing constitution, and stores the loop end address LE of each of a plurality of wave data groups each of which corresponds to each timbre. The loop end address LE from the loop end address memory 309 is supplied to the input terminal B of the comparator 314. The loop end address LE is constantly compared with data produced by adding "+1" to the integer portion in the subsequent wave readout address.

The loop end address LE from the loop end address memory 309 is supplied to the input terminal B of the comparator 310. The comparator 310 compares the integer portion of the subsequent wave readout address from the adder 307 and the loop end address LE from the loop end address memory 309. When the two are identical, "1" is outputted. Otherwise, "0" is outputted. The output of the comparator 310 is supplied to the control input terminal S0 of the selector 304. As a result, when the integer portion of the wave readout address matches the loop end address LE, the port 1 of the selector 304 is selected, and the loop top address LT (upper 16 bits) and the value of zero (lower 16 bits) are stored in the current address memory 305. Otherwise, the port 0 is selected, and the subsequent wave readout address is stored in the current address memory 305. This constitution achieves the function of repeatedly reading out the repeat portion of the wave data group in the wave memory 316.

The bank memory 311 has a time-sharing constitution, and stores the bank address for selecting one bank of the wave memory 316. The bank address from the bank memory 311 is supplied to the wave memory 316.

A envelope parameter memory 321 and an envelope generator 323 are the same as the envelope parameter memory 214 and the envelope generator 215 explained in Example 1 in constitution, operation and function, and their explanations are therefore omitted. An envelope level EL from the envelope generator 323 is supplied to a delay latch 324.

The musical tone signal generating means of the present invention includes the envelope generator 323, delay latches 324 and 325, a multiplier 326, an adder 327.

The delay latch 324 stores the envelope level EL from the envelope generator 323 synchronously with the channel clock CCK. The envelope level EL from the delay latch 324, delayed by 1 channel clock, is supplied to the delay latch 325. The delay latch 325 stores the envelope level from the delay latch 324 synchronously with the channel clock CCK. The envelope level from the delay latch 325, delayed by 2 channel clocks, is supplied to the input terminal B of the multiplier 326. The pipeline control is achieved by these delay latches 324 and 325, whereby the obtained sampling data YD delayed by 2 channel clocks and envelope data to be added to the sampling data YD are phase-adjusted.

The multiplier 326 multiplies the sampling data YD from the decoding circuit 317 and the data obtained by delaying the envelope level EL from the envelope generator 323 by 2 channel clocks. This multiplication generates a musical tone signal to which the envelope is added. The output of the multiplier 326 is supplied to an adder system 327. The adder system 327, a digital control filter 328 and a D/A converter 329 are respectively the same as the adder system 218, the digital control filter 219 and the D/A converter 220 in Example 1 in both constitution and operation.

Figure 9:
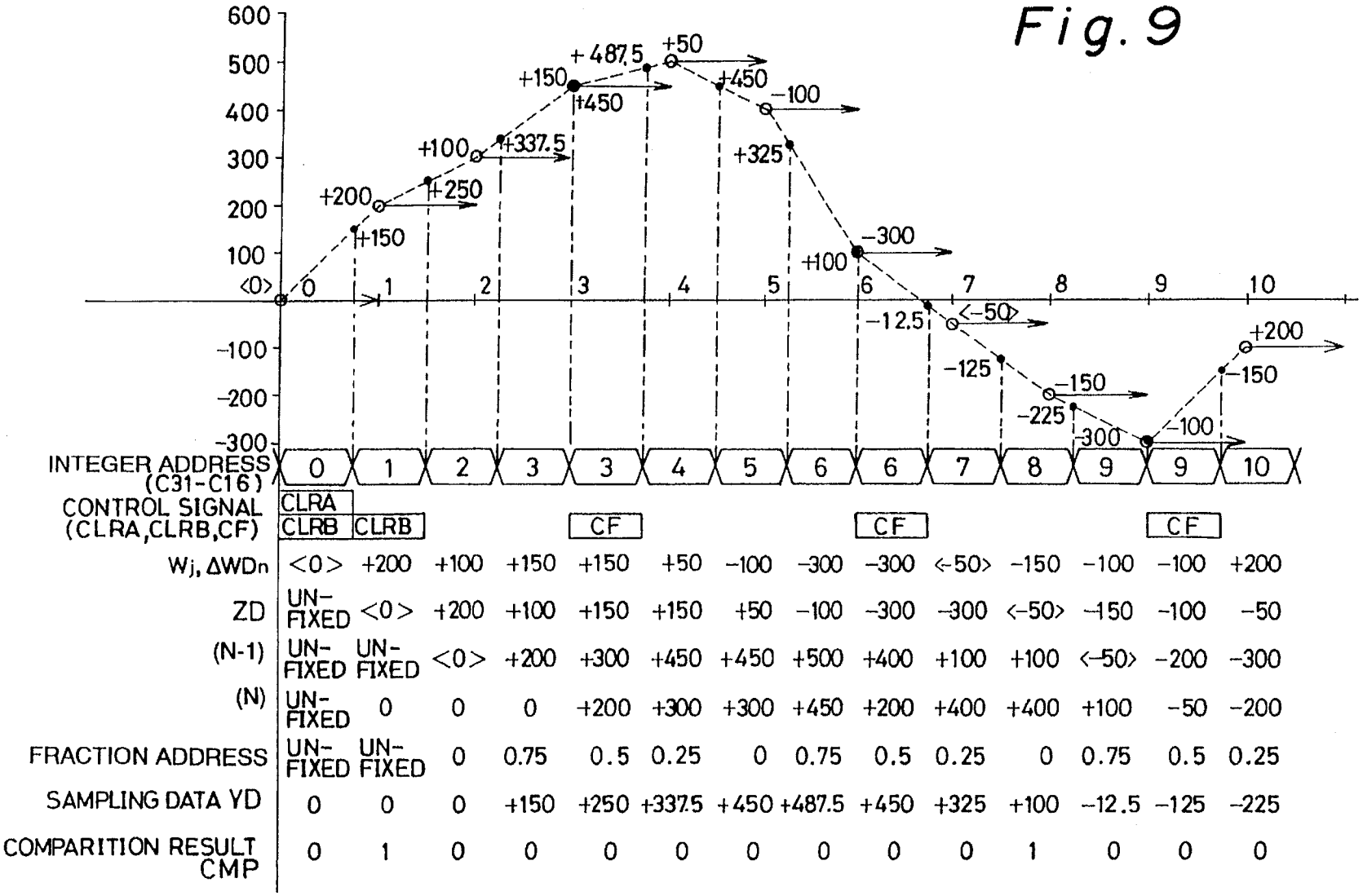
FIG. 9 schematically shows an example of storage of wave data in a wave memory and decoding operation in Example 2 for a musical tone signal generating apparatus of the present invention.

For a further understanding of Example 2, the operation in Example 2 will be explained below with reference to FIG. 9, which shows a state in which the wave data of the wave data group stored in the wave memory 316 is interpolated to output the sampling data YD. The bottom portion of FIG. 9 shows states of changes of data in essential points of the decoding circuit 317. For simplifying the explanation, the states of changes are shown in terms of decimal numbers.

In FIG. 9, points shown by white circles (spots) show the differential wave data $\Delta WD_n$ stored in the wave memory 316, and a number present in "< >" is the range value Z13. FIG. 9 shows a state in which the wave data of the wave data group is stored in addresses 0~10. That is, the D (j=0) is stored in a state in which "0" is stored in address "0", $\Delta WD_1$ is stored in a state in which "200" is stored in address "1", $\Delta WD_2$ is stored in a state in which "+100" is stored in address "2", . . .

In FIG. 9, further, a dotted line shows the transition of the sampling data YD. Black spots in the dotted line show the interpolated sampling data by the fraction address, i.e., the sampling data YD obtained by the interpolation in the decoding circuit 317. FIG. 9 shows a case of F number=0.75. Therefore, the integer address (C31–C16) of the wave readout address proceeds in "0→1→2→3→3→4→5→6→ . . . ", and the fraction address is delayed by the delay latches 122 and 123 at two cycles so that it proceeds in "unfixed→unfixed→0→0.75→0.50 (a fraction portion of the accumulated F number 0.75+0.75=1.50)→0.25 (a fraction portion of the accumulated F number 1.50+0.75=2.25) →. . . ". The wave data of the wave data group read out from the wave memory 316 is delayed by the delay latch 120 at one cycle, and shown as ZD.

The identity signal CF is produced in the tone source circuit, and is controlled to be "1" when the identical wave readout address is outputted twice or more. The identity signal CF is delayed by 1 channel clock in the delay latch 124. The control signal CMP showing the comparison result is a signal outputted from the comparator 100 of the decoding circuit 317. When the control signal CMP is "1", the output of the data converter 121 is selected by the selector 104 and supplied to the current sample memory 106.

In the wave data of the wave data group and the delayed wave data of the wave data group (ZD), data present in "< >" is the specific wave data $W_j$ of PCM format stored in the wave memory 316. The other data are the differential wave data $\Delta WD_n$ of DPCM format stored in the wave memory 316. Due to the use of the pipeline control method, there is a delay of 2 channel clocks until the result (the interpolated sampling data YD) is obtained after the output of integer portion of the wave readout address to the wave memory 316.

As explained above, according to Example 2, when the specific wave data $W_j$ is read out from the wave memory 316, the sampling data so far accumulated in the first current sample memories 106 is discarded, and the accumulation is resumed using the specific wave data $W_j$ as an initial value, so that an accumulation error inherent to the ADPCM or DPCM method can be removed. Further, an accumulation error at a non-repetitive readout time can be also prevented.

In Example 2, further, it is sufficient that the sampling data $D_j$, the content of which is within a predetermined extent, should be present even if a musical tone wave is simply sampled at a predetermined cycle. The advantage of Example 2 is that the production of the wave data group is easy.

Further, since the interpolated sampling data YD is output, the musical tone signal generating apparatus can achieve the fine adjustment of a pitch. Furthermore, unlike a conventional apparatus, it is not required to constantly read out the sampling data in two sampling data. That is, since the subsequent wave data of the wave data group is read out only when the value of the integer portion of the accumulated F number (the wave readout address) changes, the time slot corresponding to one tone generating channel can be decreased in time. As a result, the musical tone signal generating apparatus in Example 2 can achieve processing at a higher rate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A musical tone signal generating apparatus comprising:

wave storage means for storing specific wave data $W_j$ where $0 \leqq j \leqq N-1$, and differential wave data $\Delta WD_n$ where n=1, 2, . . . N−1 and n≠j, the specific wave data $W_j$ being produced based on specific sampling data $D_j$, the differential wave data $\Delta WD_n$ being obtained by deducting sampling data $D_{n-1}$ from sampling data $D_n$, wherein sampling data $D_i$ including the sample data $D_j$ and $D_n$ are obtained by sampling a musical tone wave at sampling points $P_i$ where i=0, 1, 2, . . . N−1, readout means for consecutively reading out the specific wave data $W_j$ or the differential wave data $\Delta WD_n$ from said wave storage means;

decoding means for generating sampling data $YD_j$ and storing the sampling data $YD_j$ in temporary storage when said readout means reads out the specific wave data $W_j$, and for accumulating the differential wave data $\Delta WD_n$ in the temporary storage when said readout means reads out the differential wave data $\Delta WD_n$, thereby to reproduce sampling data $YD_n$, and, musical tone signal generating means for generating a musical tone signal based on the sampling data $YD_j$ or $YD_n$.

2. The musical tone signal generating apparatus according to claim 1, wherein said readout means includes, F number generating means for generating an F number to designate a pitch, and F number accumulating means for accumulating the F number from said F number generating means at a predetermined cycle and for generating a wave readout address having an integer portion and a fraction portion, said decoding means including, interpolating means, said readout means reading out the specific wave data $W_j$ when the integer portion of the wave readout address has a value equal to j, and reads out the differential wave data $\Delta WD_n$ when the integer portion of the wave readout address has a value equal to n, from said wave storage means, said interpolating means interpolating between the sampling data $YD_{j+1}$ and $YD_j$ or between the sampling data $YD_{n+1}$ and $YD_n$ (n=1, 2, . . . N−2 and n≠j) according to a value of the fraction portion of the wave readout address, thereby to obtain interpolation data YD, said musical tone generating means further generating the musical tone signal based on the interpolation data YD.

3. The musical tone signal generating apparatus according to claim 1, wherein the differential wave data $\Delta WD_{N-1}$ is obtained by deducting sampling data $D_{N-2}$ from sampling data $D_{M-1}$ where $1 \leqq M \leqq N-3$ and $M<j<N-1$, and said readout means reads out the differential wave data $\Delta WD_M$ again, after said readout means reads out the differential wave data $\Delta WD_{N-1}$.

4. The musical tone signal generating apparatus according to claim 1, wherein the specific wave data $W_j$ is stored in said wave storage means at a location designated by j=M, and said readout means reads out the specific wave data $W_j$ where j=M again, after said readout means reads out differential wave data $\Delta WD_{N-1}$.

5. The musical tone signal generating apparatus according to claim 1, wherein a value of the specific sampling data $D_j$ is zero.

6. The musical tone signal generating apparatus according to claim 1, wherein a value of the specific sampling data $D_j$ is within a predetermined range.

* * * * *